US007749343B2

(12) United States Patent
Yoshinaga et al.

(10) Patent No.: US 7,749,343 B2
(45) Date of Patent: Jul. 6, 2010

(54) METHOD TO PRODUCE STEEL SHEET EXCELLENT IN WORKABILITY

(75) Inventors: Naoki Yoshinaga, Futtsu (JP); Nobuhiro Fujita, Futtsu (JP); Manabu Takahashi, Futtsu (JP); Koji Hashimoto, Futtsu (JP); Shinya Sakamoto, Kimitsu (JP); Kaoru Kawasaki, Himeji (JP); Yasuhiro Shinohara, Futtsu (JP); Takehide Senuma, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/185,402

(22) Filed: Aug. 4, 2008

(65) Prior Publication Data

US 2008/0308200 A1 Dec. 18, 2008

Related U.S. Application Data

(62) Division of application No. 10/487,797, filed as application No. PCT/JP02/06518 on Jun. 27, 2002, now Pat. No. 7,534,312.

(30) Foreign Application Priority Data

| | | |
|---|---|---|
| Aug. 24, 2001 | (JP) | 2001-255384 |
| Aug. 24, 2001 | (JP) | 2001-255385 |
| May 27, 2002 | (JP) | 2002-153030 |

(51) Int. Cl.
*C21D 8/02* (2006.01)
*C21D 8/04* (2006.01)

(52) U.S. Cl. ..... 148/603; 148/651; 148/652

(58) Field of Classification Search ..... 148/603, 148/661, 320, 651, 652
See application file for complete search history.

(56) References Cited

U.S. PATENT DOCUMENTS

| | | | | |
|---|---|---|---|---|
| 3,959,029 | A | 5/1976 | Matsudo et al. | |
| 4,313,770 | A | 2/1982 | Takahashi et al. | 148/652 |
| 5,582,658 | A | 12/1996 | Masui et al. | 148/518 |

FOREIGN PATENT DOCUMENTS

| | | | | |
|---|---|---|---|---|
| CN | 1101211 | A | | 4/1995 |
| EP | 0 936 279 | A1 | | 8/1999 |
| EP | 0936271 | A1 | | 8/1999 |
| EP | 0 999 288 | A1 | | 5/2000 |
| EP | 1 006 203 | A1 | | 6/2000 |
| JP | 55110734 | | * | 8/1980 |
| JP | 55158226 | | | 12/1980 |
| JP | 56-006709 | | * | 1/1981 |
| JP | 56035727 | | | 4/1981 |
| JP | A-57-73123 | | | 5/1982 |
| JP | 61-10012 | | | 3/1986 |
| JP | 63007335 | A | | 1/1988 |
| JP | 03236444 | | | 10/1991 |
| JP | 04120243 | | | 4/1992 |
| JP | A-4-337049 | A | | 11/1992 |
| JP | 06116650 | | | 4/1994 |
| JP | 07188855 | | | 7/1995 |
| JP | 09279302 | | | 10/1997 |
| JP | 10219394 | | | 8/1998 |
| JP | 11006028 | | | 1/1999 |
| JP | 1124654 | | | 5/1999 |
| JP | 11279688 | | | 10/1999 |
| JP | 1200109950 | | | 4/2000 |
| JP | 200-0282173 | | | 10/2000 |
| JP | 200-0328172 | | | 11/2000 |
| JP | 200-2115025 | | | 4/2002 |
| JP | 200-2206137 | | | 7/2002 |

* cited by examiner

*Primary Examiner*—Deborah Yee
(74) *Attorney, Agent, or Firm*—Baker Botts LLP

(57) ABSTRACT

The present invention provides a steel sheet excellent in workability, which may be used for components of an automobile or the like, and a method for producing the same. More specifically, according to one exemplary embodiment of the present invention, a steel sheet excellent in workability, including in mass, 0.08 to 0.25% C, 0.001 to 1.5% Si, 0.01 to 2.0% Mn, 0.001 to 0.06% P, at most 0.05% S, 0.001 to 0.007% N, 0.008 to 0.2% Al, at least 0.01% Fe. The steel sheet having an average r-value of at least 1.2, an r-value in the rolling direction of at least 1.3, an r-value in the direction of 45 degrees to the rolling direction of at least 0.9, and an r-value in the direction of a right angle to the rolling direction of at least 1.2.

5 Claims, No Drawings

METHOD TO PRODUCE STEEL SHEET EXCELLENT IN WORKABILITY

CROSS-REFERENCE TO RELATED APPLICATIONS

This application is a division of U.S. patent application Ser. No. 10/487,797 filed on Feb. 24, 2004 now U.S. Pat. No. 7,534,312 as a national stage application of PCT Application No. PCT/JP02/006518, which was filed on Jun. 27, 2002, and published on Mar. 6, 2003 as International Publication No. WO 03/018857 (the "International Application"). This application, like U.S. patent application Ser. No. 10/487,797, claims priority from the International Application pursuant to 35 U.S.C. §365. The present application also claims priority under 35 U.S.C. §119 from Japanese Patent Application Nos. 2001-255384, 2001-255385 and 2002-153030, filed on Aug. 24, 2001, Aug. 24, 2001 and May 27, 2002, respectively, the entire disclosures of which are incorporated herein by reference.

TECHNICAL FIELD OF THE INVENTION

The present invention relates to a steel sheet excellent in workability used for panels, undercarriage components, structural members and the like of an automobile and a method for producing the same.

The steel sheets according to the present invention include both those not subjected to surface treatment and those subjected to surface treatment such as hot-dip galvanizing, electrolytic plating or other plating for rust prevention. The plating includes the plating of pure zinc, an alloy containing zinc as the main component and further an alloy consisting mainly of Al or Al—Mg. Those steel sheets are also suitable as the materials for steel pipes for hydroforming applications.

BACKGROUND INFORMATION

With increasing needs for the reduction of an automobile weight, a piece of steel having a higher strength and less weight for a given size is increasingly desired. Strengthening of a steel sheet makes it possible to reduce an automobile's weight through reducing the thickness of the steel sheet material and increase the automobile's collision safety. In this regard, attempts have been made recently to form components of complicated shapes by applying a hydroforming method to high strength steel pipes. These processes aim to reduce the number of components, the number of welded flanges and the like in order to conform with the increasing needs for automobile weight reduction and cost reduction.

Actual application of such new forming technologies as the hydro forming method is expected to bring about significant advantages such as the reduction of cost and the expansion of design freedom. In order to fully take advantage of the hydroforming method, new materials suitable for use in this new hydroforming method are desired.

However, if it is attempted to obtain a steel sheet having a high strength and being excellent in formability, particularly deep draw ability, it has been essentially required to use an ultra-low-carbon steel containing a very small amount of C and to strengthen it by adding elements such as Si, Mn and P, as disclosed in Japanese Unexamined Patent Publication No. S56-139654, for example.

Reducing the amount of C used in the steel requires the use of vacuum degassing in the steelmaking process. During the vacuum degassing process, $CO_2$ gas is emitted in quantity.

Emitting the $CO_2$ gas is not environmentally friendly and may have substantial negative effects as to the conservation of the global environment.

Meanwhile, steel sheets that have comparatively high amounts of C and yet exhibit good deep drawability have been disclosed. Such steel sheets have been disclosed in Japanese Examined patent Publication Nos. S57-47746, H2-20695, S58-49623, S61-12983 and H1-37456, Japanese Unexamined patent Publication No. S59-13030 and others. However, even in these comparatively high C steel sheets, the amounts of C are 0.07% or less, making these comparatively high C steel sheets very-low-carbon steel sheets. Further, Japanese Examined Patent Publication No. S61-10012 discloses that a comparatively good r-value is obtained even with a C amount of 0.14%. However, the disclosed steel contains P in quantity, thereby causing the deterioration of secondary workability, problems with weldability and fatigue strength after welding in some cases. The present inventors have applied a technology to solve these problems in Japanese Patent Application No. 2000-403447.

Further, the present inventors have filed another patent application, Japanese Patent Application No. 2000-52574, regarding a steel pipe that has a controlled texture and excellent formability. However, such a steel pipe finished through high-temperature processing often contains solute C and solute N in quantity. These solute elements sometimes cause cracks to be generated during hydroforming and surface defects such as stretcher strain may be induced. Other problems with such a steel pipe include deteriorated productivity due to high-temperature thermo-mechanical treatment applied after a steel sheet has been formed into a tubular shape, negative effects on the global environment, increased cost, and the like.

SUMMARY OF THE INVENTION

The present invention relates to providing a steel sheet and a steel pipe having good r-values and methods for producing them without incurring a high cost and burdening the global environment excessively, the steel sheet being a high strength steel sheet having good formability while containing a large amount of C.

Another object of the present invention is to provide a steel sheet having yet better formability and a method for producing the steel sheet without incurring a high cost.

Still another object of the present invention is to provide a high strength steel sheet and steel pipe containing a large amount of C, having good deep drawability and containing bainite, martensite, austenite and the like, as required, other than ferrite.

Yet another object of the present invention is to provide a high strength steel sheet, while containing comparatively large amounts of C and Mn, having good deep drawability without incurring a high cost and burdening the global environment excessively.

According to one exemplary embodiment of the present invention, a steel sheet or steel pipe excellent in workability and method of making the same. The steel sheet or steel pipe including, in mass, 0.08 to 0.25% C, 0.001 to 1.5% Si, 0.01 to 2.0% Mn, 0.001 to 0.04% P, at most 0.05% S, 0.001 to 0.007% N, 0.008 to 0.2% Al, and at least 0.01% Fe. The steel sheet or steel pipe having an average r-value of at least 1.2, an r-value in the rolling direction (rL) of at least 1.3, an r-value in the direction of 45 degrees to the rolling direction (rD) of at least 0.9, and an r-value in the direction of a right angle to the rolling direction (rC) of at least 1.2.

The steel sheet or steel pipe having ratios of the X-ray diffraction intensities in the orientation components of {111}, {100} and {110} to the random X-ray diffraction intensities on a reflection plane at the thickness center of said steel sheet are 2.0 or more, 1.0 or less and 0.2 or more, respectively. The steel sheet or steel pipe having an average size of a plurality of grains of said steel sheet being 15 μm or more. The steel sheet or steel pipe having an average aspect ratio of the plurality of grains being in the range from 1.0 to less than 3.0. And further, the steel sheet or steel pipe having a metallographic microstructure composed of ferrite and precipitates.

According to another exemplary embodiment of the present invention, a method for producing a steel sheet excellent in formability. The method comprising hot rolling steel at a finishing temperature of the $Ar_3$ transformation temperature −50° C. or higher, the steel including, in mass, 0.08 to 0.25% C, 0.001 to 1.5% Si, 0.01 to 2.0% Mn, 0.001 to 0.06% P, at most 0.05% S, 0.001 to 0.007% N, 0.008 to 0.2% Al, and at least 0.01% Fe. Coiling the steel at 700° C. or lower, cold rolling the steel at a reduction ratio of 25 to less than 60%, heating the steel at an average heating rate of 4 to 200° C./h, annealing the steel at a maximum arrival temperature of 600° C. to 800° C., and cooling the steel at a rate of 5 to 100° C./h. The steel sheet having an average r-value of at least 1.2, an r-value in the rolling direction (rL) of at least 1.3, an r-value in the direction of 45 degrees to the rolling direction (rD) of at least 0.9, and an r-value in the direction of a right angle to the rolling direction (rC) of at least 1.2.

Other features and advantages of the present invention will become apparent upon reading the following detailed description of embodiments of the invention, when taken in conjunction with the appended claims.

DETAILED DESCRIPTION

An exemplary embodiment of the present invention is described below. According to an exemplary embodiment of the present invention, a steel sheet or steel pipe excellent in workability and having a relatively high amount of C and a method for making the same are provided. The present invention has been established on the basis of a finding that to make the metallographic structure of a hot-rolled steel sheet before cold rolling composed mainly of a bainite or martensite phase makes it possible to improve deep drawability of the steel sheet after cold rolling and annealing.

In general, in the case of a steel having a comparatively large amount of C, coarse hard carbides exist in the steel after being hot rolled. When the hot-rolled steel sheet is cold rolled, complicated deformation takes place in the vicinity of the carbides, and as a result, when the cold-rolled steel sheet is annealed, crystal grains having orientations unfavorable for deep drawability nucleate and grow from the vicinity of the carbides. This is considered to be the reason why the r-value is 1.0 or less in the case of a steel containing a large amount of C. If a hot-rolled steel sheet is composed mainly of a bainite phase or a martensite phase, the amount of carbides is small or, even if the amount is not very small, the carbides are extremely fine and for that reason their harmful effects are lessened.

Through varied experimentation it was discovered that, in the case of a steel containing large amounts of C and Mn, it was effective for the improvement of deep drawability to disperse carbides in a hot-rolled steel sheet evenly and finely and to make the metallographic microstructure of the hot-rolled steel sheet uniform.

Embodiment 1

According to an exemplary embodiment of the present invention a steel sheet or steel pipe having particular chemical components is provided. C is effective for strengthening steel and the reduction of the amount of C in steel causes cost of making the steel to increase. For these reasons, a C amount is set at 0.08% or more of the mass of the steel. Meanwhile, an excessive addition of C is undesirable for obtaining a good r-value, and therefore the upper limit of C is set at 0.25% of the mass of the steel. It should be noted that the r-value of the steel is improved when the amount of C is reduced to less than 0.08% of the mass of the steel. However, reduction of the amount of C to such a low amount is excluded due to other negative side effects of such reduction. A preferable range of an amount of C is from approximately more than 0.10 to 0.18% of the mass of the steel.

Addition of Si increases the mechanical strength of steel economically and thus it may be added to achieve a required strength level. However, excessive addition of Si causes not only the wettability of plating and workability but the r-value of the steel deteriorates. For this reason, the upper limit of Si should be limited to an amount of no more than approximately 1.5% of the mass of the steel. The lower limit of Si should be limited to an amount of at least approximately 0.001% of the mass of the steel, because an Si amount lower than 0.001% by mass is hardly obtainable by the current steelmaking technology. Preferably, upper limit of Si should be limited to an amount of no more than 0.5% of the mass of the steel.

Mn is effective for strengthening a steel and may be added as required. However, since excessive addition of Mn deteriorates the r-value of steel, the upper limit of Mn should be limited to an amount of no more than 2.0% of the mass of the steel. The lower limit of Mn should be set at no less than 0.01% of the mass of the steel, because an Mn amount lower than that causes steelmaking cost to increase and S-induced hot-rolling cracks to occur. Preferably, the range of Mn is from approximately 0.04 to 0.8% of the mass of the steel. When a higher r-value is required, a lower Mn amount is preferable and therefore a preferable range of Mn is from approximately 0.04 to 0.12% of the mass of the steel.

P is an element effective for strengthening steel and hence P is added by approximately 0.001% or more of the mass of the steel. However, when P is added by 0.04% or more of the mass of the steel, weldability, the fatigue strength of a weld and resistance to brittleness in secondary working deteriorates. For this reason, an upper limit of an amount of P is approximately 0.06% of the mass of the steel. A preferable amount of P is less than approximately 0.04% of the mass of the steel.

The element S appears frequently in steel, however, S is an impurity element and therefore the lower the amount of S the better. An amount of S is set at approximately 0.05% or less of the mass of the steel in order to prevent hot cracking. More than that amount of S may cause hot cracking. A preferable amount of S is approximately 0.015% or less of the mass of the steel. Further, the desirable amount of S is related to the desirable amount of Mn; it is preferable to satisfy the expression Mn/S>10.

N should be added of an amount approximately 0.001% or more of the mass of the steel in order to secure a good r-value. However, excessive N addition causes aging properties to deteriorate and requires a large amount of Al to be added. For this reason, the addition of N should be limited to 0.007% of the mass of the steel. Preferably, the amount of N should be limited from approximately 0.002 to 0.005% of the mass of the steel.

Al is also necessary for securing a good r-value and hence is added by at least 0.008% of the mass of the steel. However, when Al is added excessively, the positive effect is lessened and surface defects are induced. For this reason, the upper limit of Al is set at approximately 0.2% of the mass of the steel. A preferable range of Al is from approximately 0.015 to 0.07% of the mass of the steel.

In a steel pipe produced according to the present invention, the r-value in the axial direction (rL) of the steel pipe is 1.3 or more. An r-value is obtained by conducting a tensile test using a JIS #12 arc-shaped test piece and calculating the r-value from the changes of the gauge length and the width of the test piece after the application of 15% tension in accordance with the definition of an r-value. Here, if a uniform elongation is less than 15%, the r-value may be calculated on the basis of the figures after the application of 10% tension.

The r-value of an arc-shaped test piece is generally different from that of a flat test piece. Further, an r-value changes with the change of the diameter of an original steel pipe and moreover the change in the curvature of an arc is hardly measurable. For these reasons, it is desirable to measure an r-value by attaching a strain gauge to a test piece. An rL value of 1.4 or more is desirable for hydroforming application. With regard to the r-values of a steel pipe, usually, only an rL value is measurable because of the tubular shape. However, when a steel pipe is formed into a flat sheet by pressing or other means and r-values in other directions are measured, the r-values are evaluated as follows.

For the steel sheet or steel pipe of the present invention, an average r-value is 1.2 or more, an r-value in the direction of 45 degrees to the rolling direction (rD) is 0.9 or more, and an r-value in the direction of a right angle to the rolling direction (rC) is 1.2 or more. Preferable r-values thereof are 1.3 or more, 1.0 or more and 1.3 or more, respectively. An average r-value is given as (rL+2rD+rC)/4. In this case, an r-value may be obtained by conducting a tensile test using a JIS #13B or JIS #5B test piece and calculating the r-value from the changes of the gauge length and the width of the test piece after the application of 15% tension in accordance with the definition of an r-value. Here, if a uniform elongation is less than 15%, the r-value may be calculated on the basis of the figures after the application of 10% tension. Note that the anisotropy of r-values is $rL \geqq rC > rD$.

In a steel pipe produced according to the present invention, the average grain size of the steel pipe is 15 μm or more. A good r-value cannot be obtained with an average grain size smaller than this figure. However, when an average grain size is 60 μm or more, problems such as rough surfaces may occur during forming. For this reason, it is desirable that the average grain size be less than 60 μm. Grain size may be measured on a section perpendicular to a steel sheet surface and parallel to the rolling direction (L section) in a region from ⅜ to ⅝ of the thickness of the steel sheet by a point counting method or the like. To minimize measurement errors, it is necessary to measure in an area where 100 or more grains are observed. It is desirable to use nitral for etching. The grains here are ferrite grains, and an average grain size is the arithmetic average (simple average) of the sizes of all grains measured in the above manner.

In a steel pipe produced according to the present invention, the aging index (AI) that is evaluated through a tensile test using a JIS #12 arc-shaped test piece is 40 MPa or less. If solute C remains in quantity, there are cases where formability is deteriorated and/or stretcher strain and other defects appear during forming. A more desirable AI value is 25 MPa or less.

An AI value is measured through the following procedures. Firstly, 10% tensile deformation is applied to a test piece in the direction of the pipe axis. A flow stress under 10% tensile deformation is measured as σ1. Secondly, heat treatment is applied to the test piece for 1 h. at 100° C. and another tensile test is applied thereto, and the yield stress at this time is measured as σ2. The AI value is given as σ2-σ1.

It is well known to those skilled in the art that an AI value has a positive correlation with the amounts of solute C and N. In the case of a steel pipe produced through a diameter reducing process at a high temperature, AI exceeds 40 MPa unless the pipe undergoes a post-heat treatment at a low temperature (200° C. to 450° C.). Therefore, the case is outside the scope of the present invention. It is desirable that a steel pipe according to the present invention has a yield-point elongation of 1.5% or less at a tensile test after the artificial aging for 1 h. at 100° C.

In a steel pipe produced according to the present invention, the surface roughness is small an Ra value specified in JIS B 0601 is 0.8 or less, that contrasts with the fact that the Ra value of a steel pipe produced through a diameter reducing process at a high temperature as stated above exceeds 0.8. Preferably, the surface roughness is 0.6 or less.

In a steel pipe produced according to the present invention, the ratios of the X-ray diffraction intensities in the orientation components of {111}, {100} and {110} to the random X-ray diffraction intensities at least on a reflection plane at the thickness center are 2.0 or more, 1.0 or less and 0.2 or more, respectively. Since X-ray measurement is not applied to a steel pipe as it is, it is conducted through the following procedures.

Firstly, a test piece is appropriately cut out from a steel pipe and formed into a tabular shape by pressing or other means. Then, the thickness of the test piece is reduced to a measurement thickness by mechanical polishing or other means. Finally, the test piece is finished by chemical polishing so as to reduce the thickness by about 30 to 100 μm with intent to reduce it by an average grain size or more. The ratio of the X-ray diffraction intensities in an orientation component to the random X-ray diffraction intensities is an X-ray diffraction intensities relative to the X-ray diffraction intensities of a random sample.

The thickness center is a region from ⅜ to ⅝ of the thickness of a steel sheet, and the measurement may be taken on any plane within the region. It is commonly known that r-value increases as the component of the X-ray in the orientation component of {111} plane increases. Therefore, it is desirable that the ratio of the intensity of the X-ray diffraction intensities in the orientation component of {111} to the intensity of the random X-ray diffraction is as high as possible. However, a distinct feature of the present invention is that the ratio of the intensity of the X-ray diffraction in the orientation component of not only {111} but also {110} to the intensity of the random X-ray diffraction is higher than that of ordinary steel.

The {110} planes are usually unwelcome because they are planes that deteriorate deep drawability. However, in the present invention, it is desirable to allow the {110} planes to remain to some extent in order to increase the values of rL and rC. The {110} planes obtained through the present invention comprise {110}<110>, {110}<331>, {110}<001>, {110}<113>, etc.

In a steel pipe produced according to the present invention, the ratio(s) of the X-ray diffraction intensities in the orientation component(s) of {111}<112> and/or {554}<225> to the random X-ray diffraction intensities is/are 1.5 or more. This is because these orientation components improve formability in hydroforming and they are the orientation components hardly obtainable through a diameter reducing process at a high temperature as mentioned earlier.

Here, {hkl}<uvw> means that the crystal orientation normal to a pipe wall surface is <hkl> and that in the axial direction of a steel pipe is <uvw>. The existence of the crystal orientations expressed as the aforementioned {hkl}<uvw> can be confirmed by the X-ray diffraction intensities in the orientation components (110)[1-10], (110)[3-30], (110)[001], (110)[1-13], (111)[1-21] and (554)[−2-25] on a $\phi 2=45°$ section in the three-dimensional texture calculated by the series expansion method. It is desirable that the ratios of the intensity of the X-ray diffraction in the orientation components of (111)[1-10], (111)[1-21] and (554)[−2-25] on a $\phi 2=45°$ section to the random X-ray diffraction intensities are 3.0 or more, 2.0 or more and 2.0 or more, respectively.

In a steel pipe produced according to the present invention, the average grain size of the steel pipe is approximately 15 μm or more. A good r-value cannot be obtained with an average grain size smaller than this figure. However, when an average grain size is 60 μm or more, problems such as rough surfaces may occur during forming. For this reason, it is desirable that the average grain size is less than 60 μm. A grain size may be measured on a section perpendicular to a pipe wall surface and parallel to the rolling direction (L section) in a region from ⅜ to ⅝ of the thickness of the pipe wall by the point counting method or the like. To minimize measurement errors, it is necessary to measure in an area where 100 or more grains are observed. It is desirable to use nitral for etching. The grains here are ferrite grains, and an average grain size is the arithmetic average (simple average) of the sizes of all grains measured in the above manner.

Further, in a steel pipe produced according to the present invention, the average aspect ratio of the grains composing the steel pipe is in the range from 1.0 to 3.0. A good r-value cannot be obtained with an average aspect ratio outside this range. The aspect ratio here is identical to the elongation rate measured by the method specified in JIS G 0552. In the present invention, an aspect ratio is obtained by dividing the number of grains intersected by a line segment of a certain length parallel to the rolling direction by the number of grains intersected by a line segment of the same length normal to the rolling direction on a section perpendicular to a pipe wall surface and parallel to the rolling direction (L section) in a region from ⅜ to ⅝ of the thickness of the pipe wall. An average aspect ratio is defined as the arithmetic average (simple average) of all the aspect ratios measured in the above manner.

The present invention does not particularly specify the metallographic microstructure of a steel pipe, but it is desirable that the metallographic microstructure of the steel pipe is composed of 90% or more ferrite and cementite and/or pearlite of 10% or less from the viewpoint of securing good workability. It is more desirable that ferrite is 95% or more and cementite and/or pearlite is 5% or less. The fact that 30% or more in volume percentage of the carbides composed mainly of Fe and C exist inside ferrite grains is also another feature of the present invention.

This means that the percentage of the volume of carbides existing at grain boundaries of ferrite to the total volume of carbides is less than 30% at the largest. If carbides exist in quantity at grain boundaries, local ductility is deteriorated and the steel is unsuitable for hydroforming applications. It is more desirable that 50% or more in volume percentage of carbides exist inside ferrite grains.

The yield ratio evaluated by subjecting the steel sheet used for a steel pipe according to the present invention to a tensile test is usually 0.65 or less. The yield ratio is equal to 0.2% proof stress/maximum tensile strength. However, a yield ratio sometimes exceeds that figure when a reduction ratio in skin pass rolling is raised or a temperature in annealing is lowered. A yield ratio of 0.65 or less is desirable from the viewpoint of a shape freezing property.

In a steel pipe produced according to the present invention, it is desirable that the value of Al/N is in the range from 3 to 25. If a value is outside the above range, a good r-value is hardly obtained. A more desirable range is from 5 to 15.

B is effective for improving an r-value and resistance to brittleness in secondary working and therefore it is added as required. However, when a B amount is less than 0.0001 mass %, these effects are too small. For purposes of this specification mass % means percentage of the mass of steel. On the other hand, even when a B amount exceeds 0.01 mass %, no further effects are obtained. A preferable range of an amount of B amount is from 0.0002 to 0.0030 mass %.

Zr and Mg are elements effective for deoxidation. However, an excessive addition of Zr and Mg causes oxides, sulfides and nitrides to crystallize and precipitate in quantity and thus the cleanliness, ductility and plating properties of steel to deteriorate. For this reason, one or both of Zr and Mg may be added, as required, by approximately 0.0001 to 0.50 mass % in total.

Ti, Nb and V are also added if required. Since these elements enhance the strength and workability of steel material by forming carbides, nitrides and/or carbonitrides, one or more of them may be added by approximately 0.001 mass % or more in total. When a total addition amount of them exceeds approximately 0.2 mass %, carbides, nitrides and/or carbonitrides precipitate in quantity in the interior or at the grain boundaries of ferrite grains which are the mother phase and ductility is deteriorated. For this reason, a total addition amount of Ti, Nb and V is regulated in the range from approximately 0.001 to 0.2 mass %. Preferably, the range is from approximately 0.01 to 0.06 mass %.

Sn, Cr, Cu, Ni, Co, W and Mo are strengthening elements and one or more of them may be added as required by approximately 0.001 mass % or more in total. An excessive addition of these elements causes cost of the steel to increase and ductility to deteriorate. For this reason, the total amount of Sn, Cr, Cu, Ni, Co, W and Mo is limited to approximately 2.5 mass % or less.

Ca is effective for deoxidation in addition to the control of inclusions and an appropriate addition amount of Ca improves hot workability. However, an excessive addition of Ca accelerates hot shortness adversely. For these reasons, Ca is added in the range from approximately 0.0001 to 0.01 mass %, as required.

It should be noted that, even if a steel contains 0, Zn, Pb, As, Sb, etc. by 0.02 mass % or less each as unavoidable impurities, the effects of the present invention are not adversely affected.

In the production of a steel product according to the present invention, a steel is melted and refined in a blast furnace, a converter, an electric arc furnace and the like, successively subjected to various secondary refining processes, and cast by ingot casting or continuous casting. In the case of continuous casting, a CC-DR process or the like wherein steel is hot-rolled and cooled to a temperature near room temperature may be employed in combination. Needless to say, a cast ingot or a cast slab may be reheated and then hot rolled. The present invention does not particularly specify a reheating temperature at hot rolling. However, in order to keep AlN in a solid solution state, it is desirable that the reheating temperature is approximately 1,100° C. or higher.

A finishing temperature at hot rolling is controlled to the $Ar_3$ transformation temperature, i.e., s 50° C. or higher. A desirable finishing temperature is the $Ar_3$ transformation temperature +30° C. or higher and, more desirably, the $Ar_3$ transformation temperature +70° C. or higher. This is because, in order to improve the r-value of a final product in the present invention, it is preferable to keep the texture of a hot-rolled steel sheet as random as possible and to make the crystal grains thereof grow as much as possible.

The present invention does not particularly specify a cooling rate after hot rolling, but it is desirable that an average cooling rate down to a coiling temperature is less than 30° C./sec.

A coiling temperature is set at 700° C. or lower. The purpose is to suppress the coarsening of AlN and thus to secure a good r-value. A preferable coiling temperature is 620° C. or lower. Roll lubrication may be applied at one or more of hot rolling passes. It is also permitted to join two or more rough hot-rolled bars with each other and to apply finish hot rolling continuously. A rough hot-rolled bar may be wound into a coil and then unwound for finish hot rolling. The effects of the present invention can be realized without specifying any lower limit of a coiling temperature, but, in order to reduce the amount of solute Cr it is desirable that a coiling temperature is 350° C. or higher.

It is preferable to apply pickling after hot rolling.

Cold rolling after hot rolling is of importance in the present invention. A reduction ratio at cold rolling is regulated in the range from 25 to less than 60%. The basic concept of the prior art has been to attempt to improve an r-value by applying heavy cold rolling at a reduction ratio of 60% or more. In contrast, the present inventors newly discovered that it was essential to apply rather a low reduction ratio in cold rolling. When a cold-rolling reduction ratio is less than 25% or more than 60%, the r-value of the steel decreases. For this reason, a cold-rolling reduction ratio is regulated in the range from 25 to less than 60%, preferably from 30 to 55%.

In an annealing process, box annealing is preferably utilized, but alternate annealing processes may be adopted as long as the following conditions are satisfied. In order to obtain a good r-value, it is necessary that a heating rate is 4 to 200° C./h. Preferably the heating rate is 10 to 40° C./h. It is desirable that a maximum arrival temperature is 600° C. to 800° C. to secure a good r-value. When a maximum arrival temperature is lower than 600° C., recrystallization is not completed and workability deteriorates.

On the other hand, when a maximum arrival temperature exceeds 800° C., since the thermal history of a steel passes through a region where the ratio of a $\gamma$ phase is high in the $\alpha+\gamma$ zone, workability may sometimes deteriorate. Here, the present invention does not particularly specify a retention time at a maximum arrival temperature, but it is desirable that a retention time is 2 h. or more in the temperature range of a maximum arrival temperature −20° C. or higher in order to improve the r-value. A cooling rate is determined in consideration of sufficiently reducing the amount of solute C and is regulated in the range from approximately 5 to 100° C./h.

After annealing, skin pass rolling is applied as required in order to correct shape, control strength and secure non-aging properties at room temperature. A desirable reduction ratio of skin pass rolling is approximately 0.5 to 5.0%.

A steel sheet produced as described above is formed and welded into a steel pipe so that the rolling direction of the steel sheet may correspond to the axial direction of the steel pipe. The reason is that, even when a steel pipe is formed so that any other direction, for instance the direction of a right angle to the rolling direction, of a steel sheet may correspond to the axial direction of the pipe, the pipe is still applicable to hydroforming, but the productivity deteriorates.

In the production of a steel pipe, electric resistance welding is usually employed, but other welding and pipe forming methods such as TIG welding, MIG welding, laser welding, UO press method and butt welding may also be employed. In the production of such a welded steel pipe, solution heat treatment may be applied locally to weld heat affected zones singly or in combination or, yet, in plural stages in accordance with required properties. By so doing, the effects of the present invention are further enhanced. The heat treatment is aimed at applying to only welds and weld heat affected zones and may be applied on-line or off-line during the course of the pipe production. A similar heat treatment may be applied to an entire steel pipe for the purpose of improving workability.

Embodiment 2

According to another exemplary embodiment of the present invention, a steel sheet or steel pipe having particular chemical components is provided C is effective for strengthening steel and the reduction of the amount of C causes cost to increase. Besides, by increasing the amount of C, it becomes easy to make the metallographic microstructure of a hot-rolled steel sheet composed mainly of bainite and/or martensite. For these reasons, C is added proactively. An addition amount of C is set at approximately 0.03 mass % or more. However, an excessive addition of C is undesirable for securing a good r-value and weldability and therefore the upper limit of an amount of C is set at approximately 0.25 mass %. A desirable range of the amount of C is from approximately 0.05 to 0.17 mass %, and more desirably approximately 0.08 to 0.16 mass %.

Si raises the mechanical strength of steel economically and thus it may be added in accordance with a required strength level. Further, Si also has an effect of improving an r-value by reducing the amount of carbides existing in a hot-rolled steel sheet and making the size of the carbides small. On the other hand, an excessive addition of Si causes the wettability of plating, workability and r-value to deteriorate. For this reason, the upper limit of an Si amount is set at approximately 3.0 mass %. The lower limit of an Si amount is set at approximately 0.001 mass %, because an Si amount lower than the figure is hardly obtainable by the current steelmaking technology. A preferable range of an Si amount is from approximately 0.4 to 2.3 mass % from the viewpoint of improving an r-value.

Mn is an element that is effective not only for strengthening steel but also for making the metallographic microstructure of a hot-rolled steel sheet composed mainly of bainite and/or martensite. On the other hand, an excessive addition of Mn deteriorates an r-value and therefore the upper limit of an amount of Mn is set at approximately 3.0 mass %. The lower limit of an amount of Mn is set at approximately 0.01 mass %, because an Mn amount or amount of Mn lower than that figure causes steelmaking cost to increase and the occurrence of S-induced hot-rolling cracks to be increased. An upper limit of an Mn amount desirable for obtaining good deep drawability is approximately 2.4 mass %. In addition, in order to control the metallographic microstructure of a hot-rolled steel sheet adequately, it is desirable that the expression Mn %+11C %>1.5 is satisfied.

P is an element effective for strengthening a steel and hence P is added by approximately 0.001 mass % or more. However, when P is added in excess of approximately 0.06 mass %, weldability, the fatigue strength of a weld and resistance to brittleness in secondary working are deteriorated. For this reason, the upper limit of a P amount is set at approximately 0.06 mass %. A preferable P amount is less than approximately 0.04 mass %.

S is an impurity element and the lower the amount, the better. An S amount is set at approximately 0.05 mass % or less in order to prevent hot cracking. Preferably, an S amount is approximately 0.015 mass % or less. Further, in relation to the amount of Mn, it is preferable to satisfy the expression Mn/S>10.

N is of importance in the present invention. N forms clusters and/or precipitates with Al during slow heating after cold rolling, by so doing accelerates the development of a texture, and resultantly improves deep drawability. In order to secure a good r-value, an addition of N by approximately 0.001 mass % or more is useful. However, when an N amount is excessive, aging properties are deteriorated and it becomes necessary to add a large amount of Al. For this reason, the upper limit of an N amount is set at approximately 0.03 mass %. A preferable range of an N amount is from approximately 0.002 to 0.007 mass %.

Al is also of importance in the present invention. Al forms clusters and/or precipitates with N during slow heating after cold rolling, by so doing accelerates the development of a texture, and resultantly improves deep drawability. It is also an element effective for deoxidation. For these reasons, Al is added by approximately 0.005 mass % or more. However, an excessive addition of Al causes a cost to increase, surface defects to be induced and an r-value to be deteriorated. For this reason, the upper limit of an Al amount is set at approximately 0.3 mass %. A preferable range of an Al amount is from approximately 0.01 to 0.10 mass %.

The metallographic microstructure of a steel sheet according to the present invention is explained hereunder. The metallographic microstructure contains one or more of bainite, austenite and martensite by at least 3% in total, preferably approximately 5% or more. It is desirable that the balance consists of ferrite. This is because bainite, austenite and martensite are effective for enhancing the mechanical strength of a steel. As is well known, bainite has the effect of improving burring workability and hole expansibility, austenite that of improving an n-value and elongation, and martensite that of lowering YR (yield strength/tensile strength). For these reasons, the volume percentage of each of the above phases may be changed appropriately in accordance with the required properties of a product steel sheet. It should be noted, however, that a volume percentage less than approximately 3% does not bring about a tangible effect. For example, in order to improve burring workability, a structure consisting of bainite of 90 to 100% and ferrite of 0 to 10% is desirable, and in order to improve elongation, a structure consisting of retained austenite of 3 to 30% and ferrite of 70 to 97% is desirable. Note that the bainite mentioned here includes acicular ferrite and bainitic ferrite in addition to upper and lower bainite.

Further, in order to secure good ductility and burring workability, it is desirable to regulate the volume percentage of martensite to 30% or less and that of pearlite to 15% or less.

The volume percentage of any of these structures is defined as the value obtained by observing 5 to 20 visual fields at an arbitrary portion in the region from ¼ to ¾ of the thickness of a steel sheet on a section perpendicular to the width direction of the steel sheet under a magnification of 200 to 500 with a light optical microscope and using the point counting method. The EBSP method is also effectively adopted instead of a light optical microscope.

In a steel sheet produced according to the present invention, the average r-value of the steel sheet is 1.3 or more. In addition, the r-value in the rolling direction (rL) is 1.1 or more, the r-value in the direction of 45 degrees to the rolling direction (rD) is 0.9 or more, and the r-value in the direction of a right angle to the rolling direction (rC) is 1.2 or more. Preferably, the average r-value is 1.4 or more and the values of rL, rD and rC are 1.2 or more, 1.0 or more and 1.3 or more, respectively. An average r-value is given as (rL+2rD+rC)/4. An r-value may be obtained by conducting a tensile test using a JIS #13B or JIB #5B test piece and calculating the r-value from the changes of the gauge length and the width of the test piece after the application of 10 or 15% tension in accordance with the definition of an r-value. If a uniform elongation is less than 10%, the r-values may be evaluated by imposing a tensile deformation in the range from 3% to the uniform elongation.

In a steel sheet produced according to the present invention, the ratios of the X-ray diffraction intensities in the orientation components of {111} and {100} to the random X-ray diffraction intensities at least on a reflection plane at the thickness center are approximately 4.0 or more and approximately 3.0 or less, respectively, preferably 6.0 or more and 1.5 or less, respectively. The ratio of the intensity of the X-ray diffraction intensities in an orientation component to the intensity of the random X-ray diffraction is an X-ray diffraction intensities relative to the X-ray diffraction intensities of a random sample. The thickness center means a region from ⅜ to ⅝ of the thickness of a steel sheet, and the measurement may be taken on any plane within the region. It is desirable that the ratios of the X-ray diffraction intensities in the orientation components (111)[1-10], (111)[1-21] and (554)[−2-25] to the random X-ray diffraction intensities on a $\phi 2=45$ section in the three-dimensional texture calculated by the series expansion method are 3.0 or more, 4.0 or more and 4.0 or more, respectively. In the present invention, there are cases where the ratio of the X-ray diffraction intensities in the orientation component of {100} to the random X-ray diffraction intensities is 0.1 or more and the ratios of the X-ray diffraction intensities in both the orientation components of (110)[1-10] and (110)[001] to the random X-ray diffraction intensities on a $\phi 2=45$ section exceed 1.0. In such a case, the values of rL and rC improve.

It is desirable that the value of Al/N is in the range from 3 to 25. If a value is outside the above range, a good r-value is hardly obtained. A more desirable range is from 5 to 15.

B is effective for improving an r-value and resistance to brittleness in secondary working and therefore it is added as required. However, when an amount is less than approximately 0.0001 mass %, these effects are too small. On the other hand, even when a B amount exceeds approximately 0.01 mass %, no further effects are obtained. A preferable range of a B amount is from approximately 0.0002 to 0.0030 mass %.

Mg is an element effective for deoxidation. However, an excessive addition of Mg causes oxides, sulfides and nitrides to crystallize and precipitate in quantity and thus the cleanliness, ductility, r-value and plating properties of a steel to deteriorate. For this reason, an Mg amount is regulated in the range from approximately 0.0001 to 0.50 mass %.

Ti, Nb, V and Zr are added as required. Since these elements enhance the strength and workability of a steel material by forming carbides, nitrides and/or carbonitrides, one or more of them may be added by approximately 0.001 mass % or more in total. When a total addition amount of the elements exceeds approximately 0.2 mass %, they precipitate as carbides, nitrides and/or carbonitrides in quantity in the interior or at the grain boundaries of ferrite grains which are the mother phase and deteriorate ductility. Further, when a large amount of these elements are added, solute N is depleted in a hot-rolled steel sheet, resultantly the reaction between solute Al and solute N during slow heating after cold rolling is not secured, and an r-value is deteriorated as a result. For these reasons, an addition amount of those elements is regulated in the range from approximately 0.001 to 0.2 mass %. A desirable range is from approximately 0.001 to 0.08 mass % and more desirably from approximately 0.001 to 0.04 mass %.

Sn, Cr, Cu, Ni, Co, W and Mo are strengthening elements and one or more of them may be added as required by approximately 0.001 mass % or more in total. An excessive addition of these elements causes a cost to increase and ductility to deteriorate. For this reason, a total addition amount of the elements is set at approximately 2.5 mass % or less.

Ca is an element effective for deoxidation in addition to the control of inclusions and an appropriate addition amount of Ca improves hot workability. However, an excessive addition of Ca accelerates hot shortness adversely. For these reasons, Ca is added in the range from approximately 0.0001 to 0.01 mass %, as required.

Note that, even if a steel contains 0, Zn, Pbr As, Sb, etc. by approximately 0.02 mass % or less each as unavoidable impurities, the effects of the present invention are not adversely affected.

In the production of a steel product according to the present invention, steel is melted and refined in a blast furnace, an electric arc furnace and the like, successively subjected to various secondary refining processes, and cast by ingot casting or continuous casting. In the case of continuous casting, a CC-DR process or the like wherein a steel is hot rolled and cooled to a temperature near room temperature may be employed in combination. Needless to say, a cast ingot or a cast slab may be reheated and then hot rolled. The present invention does not particularly specify a reheating temperature at hot rolling. However, in order to keep AlN in a solid solution state, it is desirable that a reheating temperature is approximately 1,100° C. or higher. A finishing temperature at hot rolling is controlled to the $Ar_3$ transformation temperature −50° C. or higher. A preferable finishing temperature is the $Ar_3$ transformation temperature or higher. In the temperature range from the $Ar_3$ transformation temperature to the $Ar_3$ transformation temperature −100° C., the present invention does not particularly specify a cooling rate after hot rolling, but it is desirable that an average cooling rate down to a coiling temperature is 10° C./sec. or more in order to prevent AlN from precipitating. A coiling temperature is controlled in the temperature range from the room temperature to 700° C. The purpose is to suppress the coarsening of AlN and thus to secure a good r-value. A desirable coiling temperature is 620° C. or lower and more desirably 580° C. or lower. Roll lubrication may be applied at one or more of hot rolling passes. It is also permitted to join two or more rough hot-rolled bars with each other and to apply finish hot rolling continuously. A rough hot-rolled bar may be once wound into a coil and then unwound for finish hot rolling. It is preferable to apply pickling after hot rolling.

A reduction ratio at cold rolling after hot rolling is regulated in the range from 25 to 95%. When a cold-rolling reduction ratio is less than 25% or more than 95%, an r-value lowers. For this reason, a cold-rolling reduction ratio is regulated in the range from 25 to 95%. A preferable range thereof is 40 to 80%.

After cold rolling, a steel sheet is subjected to annealing to obtain a good r-value and then heat treatment to produce a desired metallographic microstructure. The preceding annealing and the succeeding heat treatment may be applied in a continuous line if possible or otherwise off-line separately. Another cold rolling at a reduction ratio of 10% or less may be applied after the annealing. In an annealing process, box annealing may be used, but another annealing process may be adopted as long as the following conditions are satisfied. In order to obtain a good r-value, it is necessary that an average heating rate is 4 to 200° C./h. A more desirable range of an average heating rate is from 10 to 40° C./h. It is desirable that a maximum arrival temperature is 600° C. to 800° C. also from the viewpoint of securing a good r-value. When a maximum arrival temperature is lower than 600° C., recrystallization is not completed and workability is deteriorated. On the other hand, when a maximum arrival temperature exceeds 800° C., since the thermal history of a steel passes through a region where the ratio of a $\gamma$ phase is high in the $\alpha+\gamma$ zone, deep drawability may sometimes be deteriorated. Here, the present invention does not particularly specify a retention time at a maximum arrival temperature, but it is desirable that a retention time is 1 h. or more in the temperature range of a maximum arrival temperature −20° C. or higher from the viewpoint of improving an revalue. The present invention does not particularly specify a cooling rate, but, when a steel sheet is cooled in a furnace of box annealing, a cooling rate is in the range from approximately 5 to 100° C./h. In this case, it is desirable that a cooling end temperature is 100° C. or lower from the viewpoint of handling for conveying a coil. Successively, heat treatment is applied to obtain any of the phases of bainite, martensite and austenite. In any of these cases, it is indispensable to apply heating at a temperature of the $Ac_1$ transformation temperature or higher, namely a temperature corresponding to the $\alpha+\gamma$ dual phase zone or higher. When a heating temperature is lower than the $Ac_1$ transformation temperature, any of the above phases cannot be obtained. A preferable lower limit of a heating temperature is the $Ac_1$ transformation temperature +30° C. On the other hand, even when a heating temperature is 1,050° C. or higher, no further effects are obtained and, what is worse, sheet traveling troubles such as heat buckles are induced. For this reason, the upper limit of a heating temperature is set at 1,050° C. A preferable upper limit is 950° C.

Better deep drawability can be obtained by controlling the metallographic microstructure of a hot-rolled steel sheet before cold rolling. It is desirable that, in the structure of a hot-rolled steel sheet, the total volume percentage of a bainite phase and/or a martensite phase is 70% or more at least in a region from ¼ to ¾ of the thickness. A more desirable total volume percentage is 80% or more, and still more desirably 90% or more. Needless to say, it is far better if such a structure is formed allover the steel sheet thickness. The reason why to make the metallographic microstructure of a hot-rolled steel sheet composed of bainite and/or martensite improves deep drawability after cold rolling and annealing is not altogether obvious, but it is estimated that the effect of fractionizing carbides and further crystal grains in a hot-rolled steel sheet as stated earlier plays the role. Note that the bainite mentioned here includes acicular ferrite and bainitic ferrite in addition to upper and lower bainite. It goes without saying that lower bainite is preferable to upper bainite from the viewpoint of fractionizing carbides. When the structure of a hot-rolled steel sheet is controlled so that such a structure as described above may be formed, it is not necessary to control a heating rate to 4 to 200° C./h. in annealing and a high r-value can be obtained even through rapid-heating annealing.

In this case, an annealing temperature is regulated in the range from the recrystallization temperature to 1,000° C. A recrystallization temperature is the temperature at which recrystallization commences. When an annealing temperature is lower than the recrystallization temperature, a good texture does not develop, the condition that the ratios of the X-ray diffraction strengths in the orientation components of {111} and {100} to the random X-ray diffraction intensities on a reflection plane at the thickness center are 3.0 or more and 3.0 or less, respectively, cannot be satisfied, and an r-value is likely to deteriorate. In the case where annealing is applied in a continuous annealing process or a continuous hot-dip galvanizing process, when an annealing temperature is raised to 1,000° C. or higher, heat buckles or the like are induced and cause problems such as strip break. For this reason, the upper limit of an annealing temperature is set at 1,000° C. When it is intended to secure a second phase of bainite, austenite, martensite and/or pearlite after annealing, needless to say, it is necessary to heat a steel sheet to the extent that an annealing temperature is in the $\alpha+\gamma$ dual phase zone or the $\gamma$ single phase zone and to select a cooling rate and overaging conditions suitable for obtaining a desired phase, and, if hot-dip galvanizing is applied, to select a plating bath temperature and the succeeding alloying temperature suitably. Naturally, box annealing can also be employed in the present invention. In this case, in order to obtain a good r-value, it is desirable that a heating rate is 4 to 200° C./h. A more desirable heating rate is 10 to 40° C./h. As stated earlier, whereas the average r-value thus obtained is 1.3 or more, bainite, austenite and/or martensite is/are hardly obtainable.

In the present invention, plating may be applied to a steel sheet after annealed as described above. The plating includes the plating of pure zinc, an alloy containing zinc as the main component and further an alloy consisting mainly of Al or Al—Mg. It is desirable that the zinc plating is applied continuously together with annealing in a continuous hot-dip galvanizing line. After immersed in a hot-dip galvanizing bath, a steel sheet may be subjected to treatment to heat and accelerate alloying of the zinc plating and the base iron. It goes without saying that, other than hot-dip galvanizing, various kinds of electrolytic plating composed mainly of zinc are also applicable.

After annealing or zinc plating, skin pass rolling is applied as required from the viewpoint of correcting shape, controlling strength and securing non-aging properties at room temperature. A desirable reduction ratio of the skin pass rolling is 0.5 to 5.0%. Here, the tensile strength of a steel sheet produced according to the present invention is 340 MPa or more.

By forming a steel sheet produced as described above into a steel pipe by electric resistance welding or another suitable welding method, for example, a steel pipe excellent in formability at hydro forming can be obtained.

Embodiment 3

According to still another embodiment of the present invention, a steel sheet or steel pipe having particular chemical components is provided. C is effective for strengthening steel and the reduction of a C amount causes cost to increase. For these reasons, a C amount is set at approximately 0.04 mass % or more. Meanwhile, an excessive addition of C is undesirable for obtaining a good r-value, and therefore the upper limit of a C amount is set at approximately 0.25 mass %. A preferable range of a C amount is from approximately 0.08 to 0.18 mass %.

Si raises the mechanical strength of a steel economically and thus it may be added in accordance with a required strength level. Further, Si is effective for fractionizing carbides and equalizing a metallographic microstructure in a hot-rolled steel sheet, and resultantly has the effect of improving deep drawability. For these reasons, it is desirable to add Si by approximately 0.2 mass % or more. On the other hand, an excessive addition of Si causes the wettability of plating, workability and weldability to deteriorate. For this reason, the upper limit of an Si amount is set at approximately 2.5 mass %. The lower limit of an Si amount is set at approximately 0.001 mass %, because an Si amount lower than the figure is hardly obtainable by the current steelmaking technology. A more desirable upper limit of a Si amount is approximately 2.0% or less.

Mn is generally known as an element that lowers an r-value. The deterioration of an r-value by Mn increases as a C amount increases. The present invention is based on the technological challenge to obtain a good r-value by suppressing such deterioration of an r-value by Mn and in that sense the lower limit of an Mn amount is set at approximately 0.8 mass %. Further, when an Mn amount is approximately 0.8 mass % or more, the effect of strengthening a steel is easy to obtain. The upper limit of an Mn amount is set at approximately 3.0 mass %, because the addition amount of Mn exceeding this figure exerts a bad influence on elongation and an r-value.

P is an element effective for strengthening a steel and hence P is added by approximately 0.001 mass % or more. However, when P is added in excess of approximately 0.06 mass %, weldability, the fatigue strength of a weld and resistance to brittleness in secondary working are deteriorated. For this reason, the upper limit of a P amount is set at approximately 0.06 mass %. A preferable P amount is less than approximately 0.04 mass %.

S is an impurity element and the lower the amount, the better. An S amount is set at approximately 0.03 mass % or less in order to prevent hot cracking. A preferable S amount is approximately 0.015 mass % or less. Further, in relation to the amount of Mn, it is preferable to satisfy the expression $Mn/S>10$.

An N addition amount of approximately 0.001 mass % or more is useful for securing a good r-value. However, an excessive N addition causes aging properties to deteriorate and requires a large amount of Al to be added. For this reason, the upper limit of an N amount is set at approximately 0.015 mass %. A more desirable range of an N amount is from approximately 0.002 to 0.007 mass %.

Al is of importance in the present invention. Al forms clusters and/or precipitates with N during slow heating after cold rolling, by so doing accelerates the development of a texture, and resultantly improves deep drawability. It is also an element effective for deoxidation. For these reasons, Al is added by approximately 0.008 mass % or more. However, an excessive addition of Al causes a cost to increase, surface defects to be induced and an r-value to be deteriorated. For this reason, the upper limit of an Al amount is set at approximately 0.3 mass %. A preferable range of an Al amount is from approximately 0.01 to 0.10 mass %.

In a steel sheet produced according to the present invention, the average r-value of the steel sheet is 1.2 or more, preferably 1.3 or more.

It is desirable that the r-value in the rolling direction (rL) is 1.1 or more, the r-value in the direction of 45 degrees to the rolling direction (rD) is 0.9 or more, and the r-value in the direction of a right angle to the rolling direction (rC) is 1.2 or more, preferably 1.3 or more, 1.0 or more and 1.3 or more, respectively.

An average r-value is given as (rL+2rD+rC)/4. An r-value may be obtained by conducting a tensile test using JIS #13B test piece and calculating the r-value from the changes of the gauge length and the width of the test piece after the application of 10 or 15% tension in accordance with the definition of an r-value.

In a steel sheet produced according to the present invention, the main phase of the metallographic microstructure of the steel sheet is composed of ferrite and precipitate and the ferrite and precipitate account for 99% or more in volume. The precipitate usually consists mainly of carbides (cementite, in most cases), but in some chemical compositions, nitrides, carbonitrides, sulfides, etc. also precipitate. In the metallographic microstructure of a steel sheet produced according to the present invention, the volume percentage of retained austenite and the low temperature transformation generated phase of iron such as martensite and bainite is 1% or less.

In a steel sheet produced according to the present invention, the ratios of the X-ray diffraction intensities in the orientation components of {111} and {100} to the random X-ray diffraction intensities at least on a reflection plane at the thickness center are 4.0 or more and 2.5 or less, respectively. The ratio of the X-ray diffraction intensities in an orientation component to the random X-ray diffraction intensities is the X-ray diffraction intensities relative to the X-ray diffraction intensities of a random sample. The thickness center means a region from ⅜ to ⅝ of the thickness of a steel sheet, and the measurement may be taken on any plane within the region.

In a steel sheet produced according to the present invention, the average grain size of the steel sheet is 15 μm or more. A good r-value cannot be obtained with an average grain size smaller than this figure. However, when an average grain size is 100 μm or more, problems such as rough surfaces may occur during forming. For this reason, it is desirable that an average grain size is less than 100 μm. A grain size may be measured on a section perpendicular to a steel sheet surface and parallel to the rolling direction (L section) in a region from ⅜ to ⅝ of the thickness of the steel sheet by the point counting method or the like. To minimize measurement errors, it is necessary to measure in an area where 100 or more grains are observed. It is desirable to use nitral for etching.

Further, in a steel sheet produced according to the present invention, the average aspect ratio of the grains composing the steel sheet is in the range from 1.0 to less than 5.0. A good r-value cannot be obtained with an average aspect ratio outside this range. The aspect ratio here is identical to the elongation rate measured by the method specified in JIS G 0552. In the present invention, an aspect ratio is obtained by dividing the number of grains intersected by a line segment of a certain length parallel to the rolling direction by the number of grains intersected by a line segment of the same length normal to the rolling direction on a section perpendicular to the steel sheet surface and parallel to the rolling direction (L section) in a region from ⅜ to ⅝ of the thickness of a steel sheet. A preferable range of an average aspect ratio is from 1.5 to less than 4.0.

The yield ratio evaluated by subjecting a steel sheet according to the present invention to a tensile test is usually less than 0.70. A preferable yield ratio is 0.65 or less from the viewpoint of securing a shape freezing property and suppressing surface distortion during press forming. The yield ratio of a steel sheet according to the present invention is low and therefore the n-value thereof is also good. The n-value is high particularly in the region of a low strain (10% or less). The present invention does not particularly specify any lower limit of a yield ratio, but it is desirable that a yield ratio is 0.40 or more, for instance, in order to prevent buckling during hydroforming.

It is desirable that the value of Al/N is in the range from 3 to 25. If a value is outside the above range, a good r-value is hardly obtained. A more desirable range is from 5 to 15.

B is effective for improving an r-value and resistance to brittleness in secondary working and therefore it is added as required. However, when a B amount is less than approximately 0.0001 mass %, these effects are too small. On the other hand, even when a B amount exceeds approximately 0.01 mass %, no further effects are obtained. A preferable range of a B amount is from approximately 0.0002 to 0.0020 mass %.

Zr and Mg are elements effective for deoxidation. However, an excessive addition of Zr and Mg causes oxides, sulfides and nitrides to crystallize and precipitate in quantity and thus the cleanliness, ductility and plating properties of a steel to deteriorate. For this reason, one or both of Zr and Mg may be added, as required, by approximately 0.0001 to 0.50 mass % in total.

Ti, Nb and V are also added if required. Since these elements enhance the strength and workability of a steel material by forming carbides, nitrides and/or carbonitrides, one or more of them may be added by approximately 0.001 mass % or more in total. When a total addition amount of them exceeds approximately 0.2 mass %, carbides, nitrides and/or carbonitrides precipitate in quantity in the interior or at the grain boundaries of ferrite grains which are the mother phase and ductility is deteriorated. In addition, an excessive addition of these elements prevents AlN from precipitating during annealing and thus deteriorates deep drawability, which is one of the features of the present invention. For those reasons, a total addition amount of Ti, Nb and V is regulated in the range from approximately 0.001 to 0.2 mass %. A more desirable range is from approximately 0.01 to 0.03 mass %.

Sn, Cr, Eu, Ni, Co, W and Mo are strengthening elements and one or more of them may be added as required by approximately 0.001 mass % or more in total. In particular, it is desirable to add Cu by approximately 0.3% or more because Cu has the effect of improving an r-value. An excessive addition of these elements causes cost to increase and ductility to deteriorate. For this reason, a total addition amount of the elements is set at approximately 2.5 mass % or less.

Ca is an element effective for deoxidation in addition to the control of inclusions and an appropriate addition amount of Ca improves hot workability. However, an excessive addition of Ca accelerates hot shortness adversely. For these reasons, Ca is added in the range from approximately 0.0001 to 0.01 mass %, as required.

Note that, even if a steel contains 0, Zn, Pb, As, Sb, etc. by approximately 0.02 mass % or less each as unavoidable impurities, the effects of the present invention are not adversely affected.

Next, the conditions for the production of a steel sheet according to the present invention are explained hereunder.

In the production of a steel sheet according to the present invention, a steel is melted and refined in a blast furnace, an electric arc furnace and the like, successively subjected to various secondary refining processes, and cast by ingot casting or continuous casting. In the case of continuous casting, a CC-DR process or the like wherein a steel is hot rolled without cooled to a temperature near room temperature may be employed in combination. Needless to say, a cast ingot or a cast slab may be reheated and then hot rolled. The present invention does not particularly specify a reheating temperature at hot rolling. However, in order to keep AlN in a solid solution state, it is desirable that a reheating temperature is 1,100° C. or higher. A finishing temperature at hot rolling is controlled to the $Ar_3$ transformation temperature or higher. When a hot rolling finishing temperature is lower than the $Ar_3$ transformation temperature, an uneven structure is formed wherein coarse ferrite grains that have transformed at a high temperature, coarser ferrite grains that have further coarsened by recrystallization and grain growth of the coarse ferrite grains through processing, and fine ferrite grains that have transformed at a comparatively low temperature coexist in a mixed manner. The present invention does not particularly specify any upper limit of a hot rolling finishing temperature, but it is desirable that a hot rolling finishing temperature is the $Ar_3$ transformation temperature +100° C. or lower in order to uniform the metallographic structure of a hot-rolled steel sheet.

A cooling rate after hot rolling is of importance in the present invention. An average cooling rate from after finish hot rolling to a coiling temperature is set at 30° C./sec. or higher. In the present invention, it is extremely important to disperse carbides as fine as possible and to make the metallographic microstructure uniform in a hot-rolled steel sheet in improving an r-value after cold rolling and annealing. The above cooling condition at hot rolling is determined from this viewpoint. When a cooling rate is lower than 80° C./sec., not only a grain size becomes uneven but also pearlite transformation is accelerated and carbides coarsen. The present invention does not particularly specify any upper limit of a cooling rate, but, if a cooling rate is too high, the steel may become extremely hard. For this reason, it is desirable that a cooling rate is 100° C./sec. or lower.

The most desirable structure of a hot-rolled steel sheet is the one that contains bainite by 97% or more and it is better still if the bainite is lower bainite. Needless to say, it is ideal if a structure is composed of a single phase of bainite. A single phase of martensite is also acceptable, but hardness becomes excessive and thus cold rolling is hardly applied. A hot-rolled steel sheet having a structure composed of a single ferrite phase or a complex structure composed of two or more of ferrite, bainite, martensite and retained austenite is not suitable as a material for cold rolling.

A coiling temperature is set at 550° C. or lower. When a coiling temperature is higher than 550° C., AlN precipitates and coarsens, carbides also coarsen, and resultantly an r-value deteriorates. A preferable coiling temperature is lower than 500° C. Roll lubrication may be applied at one or more of hot rolling passes. It is also permitted to join two or more rough hot-rolled bars with each other and to apply finish hot rolling continuously. A rough hot-rolled bar may be once wound into a coil and then unwound for finish hot rolling. The present invention does not particularly specify any lower limit of a coiling temperature, but, in order to reduce the amount of solute C in a hot-rolled steel sheet and obtain a good r-value, it is desirable that a coiling temperature is 100° C. or higher.

It is preferable to apply pickling after hot rolling. A too high or too low reduction ratio at cold rolling after hot rolling is undesirable for obtaining good deep drawability. Therefore, a cold rolling reduction ratio is regulated in the range from 35 to less than 85%. A preferable range is from 50 to 75%.

In an annealing process, box annealing may be used, but another annealing process may be adopted as long as the following conditions are satisfied. In order to obtain a good r-value, it is necessary that a heating rate is approximately 4 to 200° C./h. A more desirable range of a heating rate is from approximately 10 to 40° C./h. It is desirable that a maximum arrival temperature is 600° C. to 800° C. also from the viewpoint of securing a good r-value. When a maximum arrival temperature is lower than 600° C., recrystallization is not completed and workability is deteriorated. On the other hand, when a maximum arrival temperature exceeds 800° C., since the thermal history of a steel passes through a region where the ratio of a γ phase is high in the α+γ zone, workability may sometimes be deteriorated. Here, the present invention does not particularly specify a retention time at a maximum arrival temperature, but it is desirable that a retention time is 2 h. or more in the temperature range of a maximum arrival temperature −20° C. or higher from the viewpoint of improving an r-value. A cooling rate is determined in consideration of sufficiently reducing the amount of solute C and is regulated in the range from 5 to 100° C./h.

After annealing, skin pass rolling is applied as required from the viewpoint of correcting shape, controlling strength and securing non-aging properties at room temperature. A desirable reduction ratio of skin pass rolling is 0.5 to 5.0%.

Various kinds of plating may be applied to the surfaces of a steel sheet produced as described above either by hot-dip or electrolytic plating as long as the plating contains zinc and aluminum as the main components.

By forming a steel sheet produced as described above into a steel pipe by electric resistance welding or another suitable welding method, for example, a steel pipe excellent in formability at hydro forming can be obtained.

EXAMPLES

Example 1

Example 1, an example of an exemplary embodiment of the present invention is provided. Steels having the chemical components shown in Table 1 were melted, heated to 1,250° C., thereafter hot rolled at the finishing temperatures shown in Table 1, and coiled. Successively, the hot-rolled steel sheets were cold rolled at the reduction ratios shown in Table 2, thereafter annealed at a heating rate of 20° C./h. and a maximum arrival temperature of 700° C., retained for 5 h., then cooled at a cooling rate of 15° C./h., and further skin-pass rolled at a reduction ratio of 1.0%.

The workability of the produced steel sheets was evaluated through tensile tests using JIS #5 test pieces. Here, an r-value was obtained by measuring the change of the width of a test piece after the application of 15% tensile deformation. Further, some test pieces were ground nearly to the thickness center by mechanical polishing, then finished by chemical polishing and subjected to X-ray measurements.

As is obvious from Table 2, whereas any of the invention examples has good r-values and elongation, the examples not conforming to the present invention are poor in those properties.

TABLE 1

| Steel code | C | Si | Mn | P | S | Al | N | Al/N | Others | Hot rolling finishing temperature (° C.) | Coiling temperature (° C.) |
|---|---|---|---|---|---|---|---|---|---|---|---|
| A | 0.11 | 0.04 | 0.44 | 0.014 | 0.003 | 0.025 | 0.0019 | 13.2 | — | 870 | 600 |
| B | 0.13 | 0.01 | 0.33 | 0.015 | 0.006 | 0.029 | 0.0033 | 8.8 | — | 930 | 550 |
| C | 0.11 | 0.03 | 0.45 | 0.011 | 0.002 | 0.051 | 0.0044 | 11.6 | — | 850 | 580 |
| D | 0.12 | 0.01 | 0.09 | 0.009 | 0.005 | 0.044 | 0.0038 | 11.6 | — | 900 | 610 |
| E | 0.11 | 0.02 | 0.48 | 0.035 | 0.003 | 0.028 | 0.0033 | 8.5 | — | 860 | 540 |

TABLE 1-continued

| Steel code | C | Si | Mn | P | S | Al | N | Al/N | Others | Hot rolling finishing temperature (° C.) | Coiling temperature (° C.) |
|---|---|---|---|---|---|---|---|---|---|---|---|
| F | 0.12 | 0.23 | 0.26 | 0.036 | 0.003 | 0.030 | 0.0029 | 10.3 | — | 890 | 580 |
| G | 0.16 | 0.05 | 0.65 | 0.013 | 0.004 | 0.035 | 0.0027 | 13.0 | — | 830 | 520 |
| H | 0.16 | 0.38 | 0.79 | 0.054 | 0.004 | 0.062 | 0.0049 | 12.7 | — | 910 | 590 |
| I | 0.19 | 0.01 | 0.30 | 0.012 | 0.003 | 0.042 | 0.0040 | 10.5 | — | 880 | 600 |
| J | 0.11 | 0.05 | 0.35 | 0.016 | 0.003 | 0.024 | 0.0036 | 6.7 | B = 0.0004 | 850 | 570 |
| K | 0.13 | 0.11 | 0.12 | 0.010 | 0.005 | 0.039 | 0.0033 | 11.8 | Ca = 0.002, Sn = 0.02, Cr = 0.03, Cu = 0.1 | 860 | 600 |
| L | 0.12 | 0.01 | 0.40 | 0.007 | 0.003 | 0.022 | 0.0020 | 11.0 | Mg = 0.01 | 870 | 620 |
| M | 0.11 | 0.05 | 0.35 | 0.016 | 0.003 | 0.041 | 0.0047 | 8.7 | Ti = 0.006, Nb = 0.003 | 880 | 500 |

TABLE 2

| Steel code | | Cold rolling reduction ratio (%) | r-value: Average r-value | rL | rD | rC | Ratio of X-ray diffraction intensities to random X-ray diffraction strength: (111) | (100) | (110) | Average grain size (μm) | Average aspect ratio |
|---|---|---|---|---|---|---|---|---|---|---|---|
| A | -1 | 20 | 1.12 | 1.21 | 1.05 | 1.18 | 1.6 | 1.0 | 0.24 | 41 | 1.4 |
| | -2 | 30 | 1.26 | 1.42 | 1.11 | 1.39 | 2.4 | 0.6 | 0.25 | 35 | 1.6 |
| | -3 | 40 | 1.53 | 1.91 | 1.25 | 1.72 | 3.8 | 0.3 | 0.27 | 32 | 1.6 |
| | -4 | 50 | 1.39 | 1.80 | 1.05 | 1.64 | 3.0 | 0.5 | 0.22 | 29 | 1.9 |
| | -5 | 70 | 1.16 | 1.34 | 1.06 | 1.19 | 2.3 | 1.1 | 0.15 | 13 | 2.6 |
| B | -1 | 40 | 1.61 | 2.15 | 1.20 | 1.88 | 3.4 | 0.2 | 0.36 | 34 | 1.3 |
| | -2 | 80 | 1.03 | 1.19 | 0.93 | 1.06 | 2.5 | 1.1 | 0.18 | 15 | 3.4 |
| C | -1 | 50 | 1.52 | 1.85 | 1.31 | 1.61 | 3.6 | 0.3 | 0.22 | 25 | 1.9 |
| | -2 | 70 | 1.17 | 1.43 | 1.07 | 1.09 | 2.4 | 0.9 | 0.11 | 12 | 2.9 |
| D | -1 | 15 | 1.18 | 1.34 | 1.09 | 1.19 | 1.8 | 1.1 | 0.19 | 46 | 1.3 |
| | -2 | 35 | 1.42 | 1.73 | 1.25 | 1.44 | 3.5 | 0.4 | 0.28 | 31 | 1.7 |
| | -3 | 45 | 1.74 | 2.28 | 1.30 | 2.06 | 4.0 | 0.1 | 0.25 | 28 | 1.7 |
| | -4 | 55 | 1.71 | 2.37 | 1.24 | 2.00 | 4.1 | 0.1 | 0.23 | 26 | 2.0 |
| | -5 | 75 | 1.06 | 1.40 | 0.88 | 1.09 | 1.9 | 1.2 | 0.08 | 14 | 3.0 |
| E | -1 | 35 | 1.42 | 1.76 | 1.15 | 1.60 | 2.7 | 0.6 | 0.33 | 23 | 1.5 |
| | -2 | 85 | 0.98 | 1.16 | 0.87 | 1.02 | 2.6 | 1.2 | 0.08 | 14 | 4.4 |
| F | -1 | 40 | 1.39 | 1.67 | 1.19 | 1.52 | 3.7 | 0.3 | 0.29 | 33 | 1.6 |
| | -2 | 75 | 0.93 | 1.03 | 0.85 | 0.99 | 2.2 | 1.0 | 0.14 | 18 | 2.5 |
| G | -1 | 45 | 1.31 | 1.58 | 1.09 | 1.46 | 3.0 | 0.3 | 0.46 | 35 | 2.0 |
| | -2 | 70 | 0.98 | 1.16 | 0.87 | 1.02 | 2.6 | 1.2 | 0.08 | 12 | 4.4 |
| H | -1 | 55 | 1.32 | 1.55 | 1.15 | 1.42 | 3.2 | 0.4 | 0.32 | 30 | 2.4 |
| | -2 | 80 | 0.91 | 1.04 | 0.80 | 0.99 | 2.6 | 1.2 | 0.08 | 11 | 5.2 |
| I | -1 | 50 | 1.33 | 1.60 | 1.12 | 1.49 | 2.7 | 0.4 | 0.33 | 31 | 2.2 |
| | -2 | 65 | 1.04 | 1.24 | 0.90 | 1.13 | 2.3 | 0.9 | 0.12 | 16 | 1.5 |
| J | -1 | 50 | 1.55 | 2.00 | 1.22 | 1.76 | 3.1 | 0.1 | 0.59 | 31 | 1.8 |
| | -2 | 80 | 1.04 | 1.21 | 0.95 | 1.06 | 4.6 | 1.2 | 0.05 | 13 | 3.8 |
| K | -1 | 40 | 1.55 | 1.92 | 1.26 | 1.76 | 3.8 | 0.2 | 0.62 | 40 | 1.6 |
| | -2 | 70 | 1.08 | 1.24 | 0.99 | 1.08 | 3.0 | 1.0 | 0.17 | 14 | 3.3 |
| L | -1 | 50 | 1.40 | 1.66 | 1.17 | 1.60 | 2.7 | 0.3 | 0.55 | 28 | 2.1 |
| | -2 | 10 | 0.96 | 1.01 | 0.93 | 0.96 | 1.6 | 1.2 | 0.40 | 23 | 1.2 |
| M | -1 | 35 | 1.37 | 1.60 | 1.22 | 1.43 | 2.5 | 0.4 | 0.29 | 40 | 1.9 |
| | -2 | 65 | 1.12 | 1.28 | 1.05 | 1.11 | 1.9 | 1.1 | 0.12 | 18 | 3.1 |

| Steel code | | Other tensile properties: TS (MPa) | YS (MPa) | Yield ratio | Total elongation (%) | n-value | Classification |
|---|---|---|---|---|---|---|---|
| A | -1 | 349 | 152 | 0.44 | 49 | 0.25 | Comparative example |
| | -2 | 352 | 159 | 0.45 | 47 | 0.24 | Invention example |
| | -3 | 356 | 160 | 0.45 | 47 | 0.24 | Invention example |
| | -4 | 358 | 165 | 0.46 | 46 | 0.24 | Invention example |
| | -5 | 365 | 181 | 0.50 | 45 | 0.23 | Comparative example |
| B | -1 | 367 | 182 | 0.50 | 45 | 0.23 | Invention example |
| | -2 | 385 | 206 | 0.54 | 43 | 0.21 | Comparative example |
| C | -1 | 360 | 180 | 0.50 | 45 | 0.22 | Invention example |
| | -2 | 373 | 197 | 0.53 | 44 | 0.21 | Comparative example |
| D | -1 | 341 | 140 | 0.41 | 50 | 0.25 | Comparative example |

TABLE 2-continued

| | | | | | | | |
|---|---|---|---|---|---|---|---|
| | -2 | 350 | 163 | 0.47 | 48 | 0.23 | Invention example |
| | -3 | 347 | 149 | 0.43 | 49 | 0.24 | Invention example |
| | -4 | 350 | 155 | 0.44 | 49 | 0.24 | Invention example |
| | -5 | 356 | 175 | 0.49 | 46 | 0.22 | Comparative example |
| E | -1 | 389 | 205 | 0.53 | 43 | 0.21 | Invention example |
| | -2 | 410 | 226 | 0.55 | 41 | 0.20 | Comparative example |
| F | -1 | 403 | 219 | 0.54 | 39 | 0.19 | Invention example |
| | -2 | 422 | 240 | 0.57 | 38 | 0.18 | Comparative example |
| G | -1 | 423 | 224 | 0.53 | 42 | 0.20 | Invention example |
| | -2 | 410 | 226 | 0.55 | 41 | 0.20 | Comparative example |
| H | -1 | 492 | 296 | 0.60 | 33 | 0.16 | Invention example |
| | -2 | 514 | 318 | 0.62 | 31 | 0.15 | Comparative example |
| I | -1 | 434 | 237 | 0.55 | 40 | 0.19 | Invention example |
| | -2 | 418 | 240 | 0.57 | 38 | 0.18 | Comparative example |
| J | -1 | 370 | 186 | 0.50 | 44 | 0.22 | Invention example |
| | -2 | 388 | 210 | 0.54 | 43 | 0.21 | Comparative example |
| K | -1 | 376 | 190 | 0.51 | 43 | 0.21 | Invention example |
| | -2 | 392 | 216 | 0.55 | 42 | 0.20 | Comparative example |
| L | -1 | 371 | 185 | 0.50 | 43 | 0.21 | Invention example |
| | -2 | 349 | 152 | 0.44 | 46 | 0.23 | Comparative example |
| M | -1 | 395 | 201 | 0.51 | 42 | 0.20 | Invention example |
| | -2 | 414 | 228 | 0.55 | 40 | 0.19 | Comparative example |

Note:
Underlined entries are outside the ranges of the present invention.

The present invention provides a high strength steel sheet excellent in workability and a method for producing the steel sheet, and contributes to the conservation of the global environment and the like.

Example 2

Example 2, an example of another exemplary embodiment of the present invention is provided. Steels having the chemical components shown in Table 3 were melted, heated to 1,230° C., thereafter hot rolled at the finishing temperatures shown in Table 3, and coiled. The hot-rolled steel sheets were pickled, thereafter cold rolled at the reduction ratios shown in Table 4, thereafter annealed at a heating rate of 20° C./h. and a maximum arrival temperature of 690° C., retained for 12 h., cooled at a cooling rate of 17° C./h., and further skin-pass rolled at a reduction ratio of 1.5%. The produced steel sheets were formed into steel pipes by electric resistance welding.

The workability of the produced steel pipes was evaluated by the following method. A scribed circle 10 mm in diameter was transcribed on the surface of a steel pipe beforehand and stretch forming was applied to the steel pipe in the circumferential direction while the inner pressure and the amount of axial compression were controlled. A strain in the axial direction $\epsilon\Phi$ and a strain in the circumferential direction $\epsilon\theta$ were measured at the portion that showed the maximum expansion ratio (expansion ratio=maximum circumference after forming/circumference of mother pipe) just before burst occurred. The ratio of the two strains $\rho=\epsilon\Phi/\epsilon\theta$ and the maximum expansion ratio were plotted and the expansion ratio Re when $\rho$ was −0.5 was defined as an indicator of the formability in hydroforming. The mechanical properties of a steel pipe were evaluated using a JIS #12 arc-shaped test piece. Since an r-value was influenced by the shape of a test piece, the measurement was carried out with a strain gauge attached to a test piece. The X-ray measurement was carried out as follows. A tabular test piece was prepared by cutting out a arc-shaped test piece from a steel pipe after diameter reduction and then pressing it. Then, the tabular test piece was ground nearly to the thickness center by mechanical polishing, then finished by chemical polishing and subjected to X-ray measurement.

As is obvious from Table 4, whereas any of the invention examples has good r-values and elongation, the examples not conforming to the present invention are poor in those properties.

TABLE 3

| Steel code | C | Si | Mn | P | S | Al | N | Al/N | Others | Hot rolling finishing temperature (° C.) | Coiling temperature (° C.) |
|---|---|---|---|---|---|---|---|---|---|---|---|
| A | 0.11 | 0.04 | 0.44 | 0.014 | 0.003 | 0.025 | 0.0019 | 13.2 | — | 860 | 590 |
| B | 0.13 | 0.01 | 0.33 | 0.015 | 0.006 | 0.029 | 0.0033 | 8.8 | — | 940 | 560 |
| C | 0.11 | 0.03 | 0.45 | 0.011 | 0.002 | 0.051 | 0.0044 | 11.6 | — | 860 | 600 |
| D | 0.12 | 0.01 | 0.09 | 0.009 | 0.005 | 0.044 | 0.0038 | 11.6 | — | 910 | 600 |
| E | 0.11 | 0.02 | 0.48 | 0.035 | 0.003 | 0.028 | 0.0033 | 8.5 | — | 860 | 550 |
| F | 0.12 | 0.23 | 0.26 | 0.036 | 0.003 | 0.030 | 0.0029 | 10.3 | — | 900 | 570 |
| G | 0.16 | 0.05 | 0.65 | 0.013 | 0.004 | 0.035 | 0.0027 | 13.0 | — | 840 | 510 |
| H | 0.16 | 0.38 | 0.79 | 0.054 | 0.004 | 0.062 | 0.0049 | 12.7 | — | 900 | 580 |
| I | 0.19 | 0.01 | 0.30 | 0.012 | 0.003 | 0.042 | 0.0040 | 10.5 | — | 890 | 560 |
| J | 0.11 | 0.05 | 0.35 | 0.016 | 0.003 | 0.024 | 0.0036 | 6.7 | B = 0.0004 | 840 | 520 |
| K | 0.12 | 0.06 | 0.11 | 0.008 | 0.004 | 0.025 | 0.0026 | 9.6 | Cu = 1.4, Ni = 0.7 | 860 | 590 |
| L | 0.12 | 0.01 | 0.40 | 0.007 | 0.003 | 4.022 | 0.0020 | 11.0 | Mg = 0.01 | 880 | 610 |
| M | 0.11 | 0.05 | 0.35 | 0.016 | 0.003 | 0.041 | 0.0047 | 8.7 | Ti = 0.006, Nb = 0.003 | 870 | 500 |

TABLE 4

| Steel code | | Cold rolling reduction ratio (%) | rL | Ratio of X-ray diffraction intensities to random X-ray diffraction intensities: Average grain size (μm) | Al, MPa | Ra | (111) | (100) | (110) | Average aspect ratio | Other tensile properties: TS (MPa) | YS (MPa) | Total elongation (%) | n-value | Maximum expansion ratio | Classification |
|---|---|---|---|---|---|---|---|---|---|---|---|---|---|---|---|---|
| A | -1 | 20 | 1.19 | 15 | 14 | 0.5 | 1.2 | 1.3 | 0.24 | 1.3 | 366 | 275 | 54 | 0.19 | 1.38 | Comparative example |
| | -2 | 30 | 1.44 | 26 | 10 | 0.4 | 2.3 | 0.5 | 0.25 | 2.1 | 372 | 290 | 53 | 0.18 | 1.42 | Invention example |
| | -3 | 40 | 1.87 | 24 | 9 | 0.4 | 4.0 | 0.3 | 0.24 | 2.2 | 381 | 286 | 53 | 0.19 | 1.45 | Invention example |
| | -4 | 50 | 1.93 | 22 | 7 | 0.3 | 3.8 | 0.3 | 0.27 | 2.6 | 385 | 289 | 52 | 0.18 | 1.43 | Invention example |
| | -5 | 70 | 1.29 | 14 | 5 | 0.2 | 1.9 | 1.1 | 0.16 | 3.1 | 392 | 304 | 50 | 0.17 | 1.39 | Comparative example |
| B | -1 | 40 | 2.03 | 36 | 1 | 0.2 | 3.2 | 0.2 | 0.33 | 1.8 | 400 | 301 | 52 | 0.17 | 1.46 | Invention example |
| | -2 | 80 | 1.22 | 16 | 0 | 0.1 | 2.6 | 1.0 | 0.20 | 4.0 | 413 | 316 | 48 | 0.15 | 1.38 | Comparative example |
| C | -1 | 50 | 2.25 | 25 | 8 | 0.2 | 4.4 | 0.2 | 0.40 | 2.4 | 394 | 307 | 51 | 0.16 | 1.45 | Invention example |
| | -2 | 70 | 1.40 | 12 | 7 | 0.2 | 2.4 | 0.9 | 0.10 | 3.6 | 405 | 299 | 49 | 0.15 | 1.41 | Comparative example |
| D | -1 | 15 | 1.11 | 13 | 12 | 0.4 | 1.5 | 1.9 | 0.65 | 1.2 | 367 | 364 | 51 | 0.20 | 1.45 | Comparative example |
| | -2 | 35 | 1.75 | 35 | 5 | 0.3 | 3.4 | 0.4 | 0.30 | 2.2 | 376 | 269 | 54 | 0.18 | 1.51 | Invention example |
| | -3 | 45 | 2.51 | 33 | 4 | 0.3 | 4.3 | 0.1 | 0.36 | 2.3 | 377 | 286 | 55 | 0.18 | 1.52 | Invention example |
| | -4 | 55 | 2.03 | 29 | 4 | 0.3 | 4.0 | 0.2 | 0.29 | 2.5 | 380 | 285 | 55 | 0.19 | 1.51 | Invention example |
| | -5 | 75 | 1.44 | 14 | 2 | 0.2 | 2.0 | 1.3 | 0.10 | 3.6 | 385 | 300 | 51 | 0.15 | 1.44 | Comparative example |
| E | -1 | 35 | 1.80 | 22 | 16 | 0.5 | 2.7 | 0.5 | 0.34 | 1.7 | 417 | 316 | 49 | 0.16 | 1.43 | Invention example |
| | -2 | 85 | 1.09 | 13 | 13 | 0.2 | 2.4 | 1.3 | 0.02 | 4.4 | 433 | 335 | 47 | 0.13 | 1.45 | Comparative example |
| F | -1 | 40 | 1.65 | 30 | 17 | 0.4 | 3.5 | 0.4 | 0.29 | 2.1 | 439 | 336 | 45 | 0.19 | 1.44 | Invention example |
| | -2 | 75 | 0.99 | 17 | 15 | 0.1 | 1.9 | 1.1 | 0.10 | 2.8 | 448 | 336 | 44 | 0.17 | 1.39 | Comparative example |
| G | -1 | 45 | 1.64 | 30 | 12 | 0.3 | 3.2 | 0.3 | 0.44 | 2.3 | 451 | 344 | 47 | 0.18 | 1.44 | Invention example |
| | -2 | 70 | 1.16 | 11 | 12 | 0.1 | 2.3 | 1.3 | 0.11 | 5.1 | 437 | 331 | 46 | 0.17 | 1.39 | Comparative example |
| H | -1 | 55 | 1.58 | 35 | 7 | 0.1 | 3.0 | 0.3 | 0.28 | 2.5 | 574 | 385 | 38 | 0.16 | 1.42 | Invention example |
| | -2 | 80 | 1.02 | 13 | 5 | 0.1 | 2.5 | 1.3 | 0.09 | 5.5 | 530 | 399 | 36 | 0.13 | 1.32 | Comparative example |
| I | -1 | 50 | 1.65 | 33 | 8 | 0.6 | 3.0 | 0.5 | 0.32 | 2.6 | 460 | 345 | 45 | 0.17 | 1.44 | Invention example |
| | -2 | 65 | 1.22 | 16 | 5 | 0.3 | 2.1 | 0.8 | 0.13 | 2.6 | 449 | 336 | 43 | 0.15 | 1.38 | Comparative example |
| J | -1 | 50 | 1.89 | 29 | 6 | 0.3 | 3.3 | 0.2 | 0.59 | 2.5 | 398 | 298 | 49 | 0.20 | 1.51 | Invention example |
| | -2 | 80 | 1.15 | 14 | 3 | 0.1 | 3.8 | 1.6 | 0.02 | 4.6 | 411 | 317 | 48 | 0.18 | 1.44 | Comparative example |
| K | -1 | 40 | 2.37 | 19 | 0 | 0.2 | 5.7 | 0.1 | 0.89 | 2.6 | 556 | 446 | 39 | 0.15 | 1.46 | Invention example |
| | -2 | 80 | 1.21 | 8 | 0 | 0.2 | 2.4 | 1.3 | 0.09 | 5.8 | 582 | 463 | 35 | 0.12 | 1.36 | Comparative example |
| L | -1 | 50 | 1.73 | 24 | 0 | 0.5 | 2.7 | 0.3 | 0.55 | 2.2 | 388 | 288 | 48 | 0.20 | 1.44 | Invention example |
| | -2 | 10 | 1.06 | 20 | 0 | 0.9 | 1.7 | 1.8 | 0.33 | 1.3 | 375 | 274 | 50 | 0.18 | 1.40 | Comparative example |
| M | -1 | 35 | 1.49 | 40 | 7 | 0.5 | 2.4 | 0.5 | 0.33 | 1.8 | 422 | 315 | 46 | 0.18 | 1.45 | Invention example |
| | -2 | 65 | 1.20 | 19 | 5 | 0.3 | 1.9 | 1.4 | 0.11 | 3.2 | 432 | 324 | 44 | 0.14 | 1.37 | Comparative example |

Note:
Underlined entries are outside the ranges of the present invention.

The present invention provides a steel pipe excellent in workability and a method for producing the steel pipe, is suitably applied to hydroforming, and contributes to the conservation of the global environment and the like.

Example 3

Example 3, an example of still another exemplary embodiment of the present invention is provided. Steels having the chemical components shown in Table 5 were melted, heated to 1,250° C., thereafter hot rolled at a finishing temperature in the range from the $Ar_3$ transformation temperature to the $Ar_3$ transformation temperature +50° C., cooled under the conditions shown in Table 6, and then coiled. The microstructures of the hot-rolled steel sheets obtained at the time are also shown in Table 6. Further, the hot-rolled steel sheets were cold rolled under the conditions shown in Table 6. Successively, the cold-rolled steel sheets were subjected to continuous annealing at an annealing time of 60 sec. and an averaging time of 180 sec. The annealing temperatures and the averaging temperatures are shown in Table 6. Further, the steel sheets were skin-pass rolled at a reduction ratio of 0.8%.

The r-values and the other mechanical properties of the produced steel sheets were evaluated through tensile tests using JIS #13B test pieces and JIS #5B test pieces, respectively. The test pieces to be subjected to X-ray measurements were prepared by grinding nearly to the thickness center by mechanical polishing and then finishing by chemical polishing.

As is obvious from Table 6, by the present invention, good r-values can be obtained. Furthermore, a steel sheet having a composite structure wherein appropriate amounts of austenite, martensite, etc. are dispersed as well as ferrite can be obtained.

TABLE 5

| Steel code | C | Si | Mn | P | S | Al | N | Mn + 11C | Others |
|---|---|---|---|---|---|---|---|---|---|
| A | 0.11 | 0.01 | 0.44 | 0.011 | 0.002 | 0.042 | 0.0021 | 1.65 | — |
| B | 0.16 | 0.03 | 0.62 | 0.015 | 0.005 | 0.018 | 0.0024 | 2.38 | — |
| C | 0.12 | 0.01 | 1.55 | 0.007 | 0.001 | 0.050 | 0.0018 | 2.87 | — |
| D | 0.08 | 0.02 | 1.29 | 0.004 | 0.003 | 0.037 | 0.0020 | 2.17 | Nb = 0.015 |

TABLE 5-continued

| Steel code | C | Si | Mn | P | S | Al | N | Mn + 11C | Others |
|---|---|---|---|---|---|---|---|---|---|
| E | 0.05 | 1.21 | 1.11 | 0.003 | 0.004 | 0.044 | 0.0027 | 1.66 | — |
| F | 0.05 | 0.01 | 1.77 | 0.006 | 0.003 | 0.047 | 0.0023 | 2.32 | Mo = 0.12 |
| G | 0.11 | 1.20 | 1.54 | 0.004 | 0.004 | 0.035 | 0.0022 | 2.75 | — |
| H | 0.09 | 0.02 | 2.05 | 0.003 | 0.001 | 0.050 | 0.0020 | 3.04 | Ti = 0.08 |
| I | 0.15 | 1.98 | 1.66 | 0.007 | 0.005 | 0.039 | 0.0020 | 3.31 | — |
| J | 0.14 | 2.01 | 1.71 | 0.003 | 0.002 | 0.046 | 0.0019 | 3.25 | B = 0.0021 |
| K | 0.13 | 1.03 | 2.25 | 0.003 | 0.002 | 0.045 | 0.0025 | 3.68 | Ti = 0.03 |
| L | 0.15 | 0.52 | 2.51 | 0.004 | 0.003 | 0.042 | 0.0018 | 4.16 | Ti = 0.04 |

TABLE 6

| Steel code | | Average cooling rate after finish hot rolling to coiling (° C./sec.) | Coiling temperature (° C.) | Structure of hot-rolled sheet in the region from ¼ to ¾ of thickness* (Total volume percentage of B + M) | Cold rolling reduction ratio (%) | Annealing temperature (° C.) | Overaging temperature (° C.) | Microstructure after continuous annealing |
|---|---|---|---|---|---|---|---|---|
| A | -1 | 50 | 350 | F + B(87) | 70 | 720 | 400 | F |
| | -2 | 20 | 550 | F + P(0) | 70 | 720 | 400 | F |
| B | -1 | 50 | 250 | F + B(98) | 55 | 800 | 350 | F + 2% B + 7% P |
| | -2 | 10 | 600 | F + P(0) | 55 | 800 | 350 | F + 2% B + 8% P |
| C | -1 | 30 | 150 | F + B + M(92) | 65 | 750 | 450 | F |
| | -2 | 20 | 400 | F + B + P(26) | 65 | 750 | 450 | F |
| D | -1 | 60 | 400 | F + B(93) | 70 | 880 | 380 | F + 87% B |
| | -2 | 40 | 550 | F + P(24) | 70 | 880 | 380 | F + 85% B |
| E | -1 | 60 | 300 | F + B + M(96) | 80 | 800 | | F + 10% M |
| | -2 | 10 | 300 | F + P(0) | 80 | 800 | | F + 11% M |
| F | -1 | 40 | 350 | B(100) | 60 | 780 | 250 | F + 18% M |
| | -2 | 20 | 200 | F + B + M(45) | 60 | 780 | 250 | F + 20% M |
| G | -1 | 40 | 400 | F + B + P(85) | 75 | 820 | 400 | F + 4% B + 6% A |
| | -2 | 30 | 400 | F + B + A(20) | 75 | 820 | 400 | F + 3% B + 4% A |
| H | -1 | 50 | 200 | M(100) | 50 | 790 | 200 | F + 21% M |
| | -2 | 10 | 600 | F + P(0) | 50 | 790 | 200 | F + 23% M |
| I | -1 | 50 | 350 | F + B(98) | 65 | 800 | 400 | F + 7% B + 11% A |
| | -2 | 25 | 400 | F + B + A(26) | 65 | 800 | 400 | F + 7% B + 11% A |
| J | -1 | 50 | 400 | F + B(99) | 70 | 810 | 400 | F + 7% B + 10% A |
| | -2 | 15 | 400 | F + P(0) | 70 | 810 | 400 | F + 6% B + 8% A |
| K | -1 | 40 | 150 | M(100) | 40 | 840 | | F + 98% M |
| | -2 | 10 | 700 | F + P(0) | 40 | 840 | | F + 98% M |
| L | -1 | 30 | 400 | B(100) | 55 | 850 | 250 | 100% M |
| | -2 | 10 | 650 | F + P(0) | 55 | 850 | 250 | 100% M |

| Steel code | | r-value: Average r-value | rL | rD | rC | Ratio of X-ray diffraction intensities to random X-ray diffraction intensities: (111) | (100) | Other tensile properties: TS (MPa) | YS (MPa) | Total elongation (%) | n-value | Classification |
|---|---|---|---|---|---|---|---|---|---|---|---|---|
| A | -1 | 1.27 | 1.29 | 1.21 | 1.35 | 5.2 | 1.3 | 349 | 216 | 44 | 0.22 | Invention example |
| | -2 | 0.96 | 1.04 | 0.89 | 1.01 | 2.9 | 2.8 | 352 | 220 | 43 | 0.21 | Comparative example |
| B | -1 | 1.25 | 1.17 | 1.23 | 1.35 | 6.3 | 1.4 | 415 | 268 | 38 | 0.19 | Invention example |
| | -2 | 0.87 | 0.98 | 0.73 | 1.04 | 3.4 | 3.3 | 417 | 280 | 37 | 0.18 | Comparative example |
| C | -1 | 1.28 | 1.25 | 1.23 | 1.40 | 7.2 | 2.5 | 387 | 259 | 40 | 0.20 | Invention example |
| | -2 | 0.77 | 0.80 | 0.66 | 0.97 | 2.7 | 3.4 | 388 | 268 | 38 | 0.19 | Comparative example |
| D | -1 | 1.23 | 1.15 | 1.25 | 1.26 | 5.9 | 2.0 | 472 | 303 | 28 | 0.16 | Invention example |
| | -2 | 0.83 | 1.05 | 0.65 | 0.96 | 2.5 | 3.3 | 480 | 312 | 26 | 0.15 | Comparative example |
| E | -1 | 1.29 | 1.21 | 1.29 | 1.38 | 8.0 | 2.7 | 620 | 362 | 29 | 0.18 | Invention example |
| | -2 | 0.75 | 0.69 | 0.77 | 0.75 | 2.0 | 3.8 | 625 | 355 | 28 | 0.17 | Comparative example |
| F | -1 | 1.29 | 1.24 | 1.26 | 1.41 | 7.9 | 1.6 | 626 | 324 | 29 | 0.19 | Invention example |
| | -2 | 0.63 | 0.54 | 0.58 | 0.81 | 2.5 | 4.6 | 630 | 318 | 29 | 0.17 | Comparative example |
| G | -1 | 1.28 | 1.19 | 1.28 | 1.35 | 6.3 | 2.3 | 622 | 416 | 37 | 0.25 | Invention example |
| | -2 | 0.86 | 0.88 | 0.80 | 0.95 | 3.6 | 3.1 | 629 | 444 | 35 | 0.23 | Comparative example |
| H | -1 | 1.20 | 1.09 | 1.20 | 1.29 | 5.0 | 2.6 | 838 | 546 | 24 | 0.16 | Invention example |
| | -2 | 0.64 | 0.94 | 0.48 | 0.67 | 2.5 | 3.8 | 845 | 571 | 23 | 0.15 | Comparative example |
| I | -1 | 1.29 | 1.20 | 1.30 | 1.37 | 7.4 | 2.0 | 814 | 499 | 32 | 0.22 | Invention example |
| | -2 | 0.86 | 1.00 | 0.70 | 1.05 | 2.2 | 3.4 | 820 | 505 | 32 | 0.22 | Comparative example |
| J | -1 | 1.24 | 1.33 | 1.09 | 1.46 | 1.5 | 1.9 | 834 | 546 | 31 | 0.23 | Invention example |
| | -2 | 0.86 | 0.97 | 0.74 | 0.99 | 2.5 | 3.8 | 830 | 531 | 29 | 0.22 | Comparative example |

TABLE 6-continued

| | | | | | | | | | | | | |
|---|---|---|---|---|---|---|---|---|---|---|---|---|
| K | -1 | 1.21 | 1.08 | 1.19 | 1.36 | 4.6 | 2.6 | 1050 | 683 | 14 | 0.08 | Invention example |
| | -2 | 0.80 | 0.77 | 0.80 | 0.84 | 2.3 | 4.5 | 1035 | 702 | 13 | 0.08 | Comparative example |
| L | -1 | 1.22 | 1.10 | 1.22 | 1.33 | 5.2 | 2.0 | 1233 | 896 | 11 | 0.06 | Invention example |
| | -2 | 0.67 | 0.70 | 0.61 | 0.77 | 1.9 | 3.5 | 1245 | 905 | 11 | 0.06 | Comparative example |

*F: ferrite, B: bainite, M: martensite, P: pearlite, A: austenite Carbides and precipitates are omitted.
Note:
Underlined entries are outside the ranges of the present invention.

The present invention provides, in the case of a steel containing a comparatively large amount of C, a high strength steel sheet having good deep drawability without incurring a high cost and a method for producing the steel sheet, and contributes to the conservation of the global environment and the like.

Example 4

Example 4, an example of yet another exemplary embodiment of the present invention is provided. Steels having the chemical components shown in Table 7 were melted, heated to 1,250° C., thereafter hot rolled at a finishing temperature of the $Ar_3$ transformation temperature or higher, cooled under the conditions shown in Table 8, and coiled. Further, the hot-rolled steel sheets were cold rolled at the reduction ratios shown in Table 8, thereafter annealed at a heating rate of 20° C./h. and a maximum arrival temperature of 700° C., retained for 5 h., and then cooled at a cooling rate of 15° C./h. Further, the cold-rolled steel sheets were subjected to heat treatment at a heat treatment time of 60 sec. and an overaging time of 180 sec. The heat treatment temperatures and averaging temperatures are shown in Table 8. Here, some of the steel sheets as comparative examples were subjected to only the heat treatment without subjected to aforementioned annealing at 700° C. Further, skin-pass rolling was applied to the steel sheets at a reduction ratio of 1.0%.

The r-values and the other mechanical properties of the produced steel sheets were evaluated through tensile tests using JIS #13B test pieces and JIB #55 test pieces, respectively. Further, some test pieces were ground nearly to the thickness center by mechanical polishing, then finished by chemical polishing and subjected to X-ray measurements.

As is obvious from Table 8, the steel sheets having good r-values are obtained in all of the invention examples. Further, by making the metallographic microstructure of a hot-rolled steel sheet before cold rolling composed mainly of bainite and/or martensite, better r-values are obtained.

TABLE 7

| Steel code | C | Si | Mn | P | S | Al | N | Al/N | Others |
|---|---|---|---|---|---|---|---|---|---|
| A | 0.11 | 0.01 | 0.44 | 0.011 | 0.002 | 0.042 | 0.0021 | 20 | — |
| B | 0.16 | 0.03 | 0.62 | 0.015 | 0.005 | 0.018 | 0.0024 | 8 | — |
| C | 0.12 | 0.01 | 1.55 | 0.007 | 0.001 | 0.050 | 0.0018 | 28 | — |
| D | 0.08 | 0.01 | 1.32 | 0.004 | 0.003 | 0.033 | 0.0045 | 7 | Nb = 0.013 |
| E | 0.05 | 1.21 | 1.11 | 0.003 | 0.004 | 0.044 | 0.0027 | 16 | — |
| F | 0.05 | 0.01 | 1.77 | 0.006 | 0.003 | 0.047 | 0.0023 | 20 | Mo = 0.12 |
| G | 0.11 | 1.20 | 1.54 | 0.004 | 0.004 | 0.035 | 0.0022 | 16 | — |
| H | 0.09 | 0.03 | 2.14 | 0.003 | 0.002 | 0.050 | 0.0038 | 13 | B = 0.0004 |
| I | 0.15 | 1.98 | 1.66 | 0.007 | 0.005 | 0.039 | 0.0020 | 20 | — |
| J | 0.14 | 1.18 | 2.30 | 0.003 | 0.001 | 0.040 | 0.0025 | 16 | — |
| K | 0.15 | 0.63 | 2.55 | 0.004 | 0.002 | 0.045 | 0.0022 | 20 | — |

TABLE 8

| Steel code | | Average cooling rate after finish hot rolling to coiling (° C./sec.) | Coiling temperature (° C.) | Structure of hot-rolled sheet in the region from ¼ to ¾ of thickness* (Total volume percentage of B + M) | Cold rolling reduction ratio (%) | Application of annealing | Heat treatment temperature (° C.) | Overaging temperature (° C.) | Microstructure after continuous annealing |
|---|---|---|---|---|---|---|---|---|---|
| A | -1 | 50 | 350 | F + B(87) | 70 | Not applied | 760 | 400 | F + 7% B |
| | -2 | 50 | 350 | F + B(87) | 70 | Applied | 760 | 400 | F + 8% B |
| | -3 | 20 | 550 | F + P(0) | 70 | Applied | 760 | 400 | F + 9% B |
| | -4 | 20 | 550 | F + P(0) | 70 | Not applied | 760 | 400 | F + 8% B |
| B | -1 | 10 | 600 | F + P(0) | 55 | Applied | 800 | 350 | F + 6% B + 7% P |
| | -2 | 10 | 600 | F + P(0) | 55 | Not applied | 800 | 350 | F + 5% B + 8% P |
| C | -1 | 30 | 150 | F + B + M(92) | 65 | Not applied | 780 | 150 | F + 10% M |
| | -2 | 30 | 150 | F + B + M(92) | 65 | Applied | 780 | 150 | F + 9% M |
| D | -1 | 40 | 550 | F + P(24) | 70 | Applied | 880 | 380 | F + 87% B |
| | -2 | 40 | 550 | F + P(24) | 70 | Not applied | 880 | 380 | F + 85% B |
| E | -1 | 60 | 300 | F + B + M(96) | 80 | Not applied | 800 | | F + 10% M |
| | -2 | 60 | 300 | F + B + M(96) | 80 | Applied | 800 | | F + 10% M |
| | -3 | 10 | 300 | F + P(0) | 80 | Applied | 800 | | F + 10% M |
| | -4 | 10 | 300 | F + P(0) | 80 | Not applied | 800 | | F + 11% M |

TABLE 8-continued

| | | | | | | | | | |
|---|---|---|---|---|---|---|---|---|---|
| F | -1 | 40 | 350 | B(100) | 60 | Not applied | 780 | 250 | F + 18% M |
| | -2 | 40 | 350 | B(100) | 60 | Applied | 780 | 250 | F + 18% M |
| G | -1 | 30 | 400 | F + B + A(20) | 75 | Applied | 820 | 400 | F + 4% B + 5% A |
| | -2 | 30 | 400 | F + B + A(20) | 75 | Not applied | 820 | 400 | F + 3% B + 4% A |
| H | -1 | 50 | 200 | M(100) | 50 | Not applied | 790 | 200 | F + 19% M |
| | -2 | 50 | 200 | M(100) | 50 | Applied | 790 | 200 | F + 20% M |
| I | -1 | 50 | 350 | F + B(98) | 65 | Not applied | 800 | 400 | F + 7% B + 11% A |
| | -2 | 50 | 350 | F + B(98) | 65 | Applied | 800 | 400 | F + 7% B + 11% A |
| | -3 | 25 | 400 | F + B + A(26) | 65 | Applied | 800 | 400 | F + 7% B + 11% A |
| | -4 | 25 | 400 | F + B + A(26) | 65 | Not applied | 800 | 400 | F + 7% B + 11% A |
| J | -1 | 10 | 700 | F + P(0) | 40 | Applied | 840 | | F + 98% M |
| | -2 | 10 | 700 | F + P(0) | 40 | Not applied | 840 | | F + 96% M |
| K | -1 | 30 | 400 | B(100) | 55 | Not applied | 850 | 250 | 100% M |
| | -2 | 30 | 400 | B(100) | 55 | Applied | 850 | 250 | 100% M |

| Steel code | | r-value: Average r-value | rL | rD | rC | Ratio of X-ray diffraction intensities to random X-ray diffraction intensities: (111) | (100) | Other tensile properties: TS (MPa) | YS (MPa) | Total elongation (%) | n-value | Classification |
|---|---|---|---|---|---|---|---|---|---|---|---|---|
| A | -1 | 1.16 | 1.08 | 1.16 | 1.25 | 5.0 | 1.4 | 360 | 228 | 43 | 0.21 | Comparative example |
| | -2 | 1.62 | 1.48 | 1.64 | 1.70 | 8.7 | 0.4 | 353 | 210 | 45 | 0.23 | Invention example |
| | -3 | 1.48 | 1.64 | 1.34 | 1.59 | 7.7 | 0.9 | 355 | 216 | 44 | 0.22 | Invention example |
| | -4 | 0.90 | 0.98 | 0.85 | 0.90 | 2.4 | 3.5 | 359 | 230 | 41 | 0.20 | Comparative example |
| B | -1 | 1.40 | 1.56 | 1.28 | 1.46 | 7.0 | 1.2 | 420 | 297 | 36 | 0.17 | Invention example |
| | -2 | 0.85 | 0.94 | 0.71 | 1.04 | 3.2 | 3.7 | 428 | 294 | 36 | 0.17 | Comparative example |
| C | -1 | 1.20 | 1.09 | 1.21 | 1.30 | 5.5 | 2.6 | 422 | 226 | 38 | 0.19 | Comparative example |
| | -2 | 1.40 | 1.41 | 1.29 | 1.59 | 6.8 | 0.7 | 417 | 232 | 38 | 0.20 | Invention example |
| D | -1 | 1.44 | 1.44 | 1.40 | 1.53 | 7.1 | 1.4 | 485 | 319 | 25 | 0.15 | Invention example |
| | -2 | 0.83 | 1.05 | 0.65 | 0.96 | 2.5 | 3.3 | 480 | 312 | 26 | 0.15 | Comparative example |
| E | -1 | 1.29 | 1.21 | 1.27 | 1.39 | 7.7 | 3.1 | 618 | 362 | 29 | 0.18 | Comparative example |
| | -2 | 1.71 | 1.55 | 1.72 | 1.86 | 9.0 | 0.4 | 620 | 349 | 30 | 0.19 | Invention example |
| | -3 | 1.41 | 1.39 | 1.33 | 1.57 | 6.9 | 1.2 | 619 | 343 | 29 | 0.18 | Invention example |
| | -4 | 0.77 | 0.73 | 0.77 | 0.81 | 2.2 | 4.0 | 624 | 344 | 29 | 0.17 | Comparative example |
| F | -1 | 1.24 | 1.30 | 1.10 | 1.44 | 7.9 | 1.6 | 626 | 324 | 29 | 0.19 | Comparative example |
| | -2 | 1.81 | 1.66 | 1.81 | 1.95 | 10.5 | 0.2 | 635 | 321 | 29 | 0.20 | Invention example |
| G | -1 | 1.40 | 1.48 | 1.26 | 1.58 | 6.5 | 1.2 | 625 | 456 | 36 | 0.24 | Invention example |
| | -2 | 0.86 | 0.88 | 0.80 | 0.95 | 3.6 | 3.1 | 629 | 444 | 35 | 0.23 | Comparative example |
| H | -1 | 1.21 | 1.11 | 1.22 | 1.29 | 5.2 | 2.7 | 824 | 545 | 25 | 0.17 | Comparative example |
| | -2 | 1.61 | 1.60 | 1.55 | 1.72 | 8.3 | 1.3 | 831 | 554 | 24 | 0.16 | Invention example |
| I | -1 | 1.20 | 1.32 | 0.98 | 1.50 | 7.4 | 2.0 | 814 | 499 | 32 | 0.22 | Comparative example |
| | -2 | 1.77 | 1.70 | 1.75 | 1.88 | 10.6 | 0.3 | 822 | 500 | 33 | 0.22 | Invention example |
| | -3 | 1.45 | 1.42 | 1.40 | 1.59 | 6.8 | 1.5 | 830 | 486 | 33 | 0.23 | Invention example |
| | -4 | 0.86 | 1.00 | 0.70 | 1.05 | 2.2 | 3.4 | 820 | 505 | 32 | 0.22 | Comparative example |
| J | -1 | 1.41 | 1.35 | 1.35 | 1.57 | 7.2 | 1.5 | 1001 | 687 | 14 | 0.08 | Invention example |
| | -2 | 0.84 | 0.84 | 0.82 | 0.87 | 2.6 | 4.0 | 996 | 678 | 14 | 0.09 | Comparative example |
| K | -1 | 1.14 | 1.01 | 1.14 | 1.28 | 4.7 | 2.4 | 1189 | 876 | 12 | 0.07 | Comparative example |
| | -2 | 1.72 | 1.72 | 1.56 | 2.05 | 11.2 | 0.2 | 1190 | 873 | 12 | 0.07 | Invention example |

*F: ferrite, B: bainite, M: martensite, P: pearlite, A: austenite Carbides and precipitates are omitted.
Note:
Underlined entries are outside the ranges of the present invention.

The present invention provides a high strength steel sheet excellent in deep drawability and a method for producing the steel sheet, and contributes to the conservation of the global environment and the like.

Example 5

Example 5, an example of a further exemplary embodiment of the present invention is provided. Steels having the chemical components shown in Table 9 were melted, heated to 1,250° C., thereafter hot rolled at a finishing temperature in the range from the $Ar_3$ transformation temperature to the $Ar_3$ transformation temperature +50° C., and then coiled under the conditions shown in Table 10. The structures of the produced hot-rolled steel sheets are also shown in Table 10. Subsequently, the hot-rolled steel sheets were cold rolled at the reduction ratios shown in Table 10, thereafter annealed at a heating rate of 20° C./h. and a maximum arrival temperature of 700° C., retained for 5 h., thereafter cooled at a cooling rate of 15° C./h., and further skin-pass rolled at a reduction ratio of 1.0%.

The r-values of the produced steel sheets were evaluated through tensile tests using JIS #13 test pieces. The other tensile properties thereof were evaluated using JIS #5 test pieces. Here, an r-value was obtained by measuring the change of the width of a test piece after the application of 10 to 15% tensile deformation. Further, some test pieces were ground nearly to the thickness center by mechanical polishing, then finished by chemical polishing and subjected to X-ray measurements.

As is obvious from Table 10, in the invention examples, good r-values are obtained in comparison with the examples not conforming to the present invention.

TABLE 9

| Steel code | C | Si | Mn | P | S | Al | N | Al/N | Others |
|---|---|---|---|---|---|---|---|---|---|
| A | 0.11 | 0.23 | 0.95 | 0.011 | 0.005 | 0.027 | 0.0024 | 11 | — |
| B | 0.12 | 0.01 | 1.55 | 0.007 | 0.001 | 0.050 | 0.0018 | 28 | — |
| C | 0.08 | 0.01 | 1.32 | 0.004 | 0.003 | 0.033 | 0.0045 | 7 | Nb = 0.013 |
| D | 0.05 | 1.21 | 1.11 | 0.003 | 0.004 | 0.044 | 0.0027 | 16 | — |
| E | 0.05 | 0.01 | 1.77 | 0.006 | 0.003 | 0.047 | 0.0023 | 20 | Mo = 0.12 |
| F | 0.11 | 1.20 | 1.54 | 0.004 | 0.004 | 0.035 | 0.0022 | 16 | — |
| G | 0.09 | 0.03 | 2.14 | 0.003 | 0.002 | 0.050 | 0.0038 | 13 | B = 0.0004 |
| H | 0.15 | 1.98 | 1.66 | 0.007 | 0.005 | 0.039 | 0.0020 | 20 | — |
| I | 0.14 | 1.18 | 2.30 | 0.003 | 0.001 | 0.040 | 0.0025 | 16 | — |

TABLE 10

| Steel code | | Average cooling rate after finish hot rolling to coiling (° C./sec.) | Coiling temperature (° C.) | Microstructure of hot-rolled sheet in the region from ¼ to ¾ of thickness* (Total volume percentage of B + M) | Cold rolling reduction ratio (%) | | r-value: Average r-value | rL | rD | rC |
|---|---|---|---|---|---|---|---|---|---|---|
| A | -1 | 10 | 700 | F + P | 70 | 0 | 1.15 | 1.15 | 1.08 | 1.29 |
| | -2 | 50 | 400 | B | 70 | 0 | 1.46 | 1.31 | 1.52 | 1.48 |
| B | -1 | 8 | 350 | F + P | 50 | 0 | 0.99 | 1.09 | 0.94 | 1.00 |
| | -2 | 40 | 350 | B | 50 | 0 | 1.53 | 2.05 | 1.12 | 1.84 |
| C | -1 | 40 | 650 | F + P | 70 | 0 | 0.81 | 0.64 | 0.89 | 0.80 |
| | -2 | 40 | 400 | B | 70 | 0 | 1.46 | 1.85 | 1.10 | 1.77 |
| D | -1 | 10 | 600 | F + P | 80 | 0 | 1.11 | 0.99 | 1.11 | 1.22 |
| | -2 | 60 | 400 | B | 80 | 0 | 1.62 | 1.49 | 1.66 | 1.67 |
| E | -1 | 40 | 350 | B | 15 | 0 | 0.87 | 0.60 | 1.08 | 0.73 |
| | -2 | 40 | 350 | B | 65 | 0 | 1.57 | 1.54 | 1.56 | 1.61 |
| F | -1 | 30 | 450 | F + B + A | 50 | 0 | 1.14 | 1.24 | 1.09 | 1.13 |
| | -2 | 60 | 350 | B | 50 | 0 | 1.43 | 1.63 | 1.32 | 1.46 |
| G | -1 | 10 | 600 | F + P | 40 | 0 | 1.08 | 1.15 | 0.97 | 1.22 |
| | -2 | 50 | 150 | M | 40 | 0 | 1.49 | 1.37 | 1.55 | 1.49 |
| H | -1 | 50 | 350 | B | 60 | 0 | 1.54 | 1.40 | 1.58 | 1.61 |
| | -4 | 20 | 400 | F + B + A | 60 | 0 | 1.13 | 1.22 | 1.10 | 1.11 |
| I | -1 | 10 | 700 | F + P | 70 | 0 | 1.03 | 0.90 | 1.03 | 1.16 |
| | -2 | 35 | 400 | B | 70 | 0 | 1.62 | 1.42 | 1.64 | 1.78 |

| Steel code | | Ratio of X-ray diffraction intensities to random X-ray diffraction intensities (111) | (100) | Other tensile properties: TS (MPa) | YS (MPa) | YR | Total elongation (%) | Classification |
|---|---|---|---|---|---|---|---|---|
| A | -1 | 2.3 | 3.1 | 401 | 235 | 0.59 | 42 | Comparative example |
| | -2 | 6.0 | 0.9 | 404 | 233 | 0.58 | 41 | Invention example |
| B | -1 | 2.8 | 3.6 | 422 | 226 | 0.54 | 38 | Comparative example |
| | -2 | 5.8 | 0.8 | 425 | 252 | 0.59 | 38 | Invention example |
| C | -1 | 7.1 | 1.4 | 442 | 249 | 0.56 | 44 | Comparative example |
| | -2 | 6.5 | 1.6 | 438 | 240 | 0.55 | 44 | Invention example |
| D | -1 | 3.6 | 4.4 | 529 | 307 | 0.58 | 35 | Comparative example |
| | -2 | 7.5 | 0.3 | 534 | 310 | 0.58 | 36 | Invention example |
| E | -1 | 2.6 | 3.7 | 517 | 295 | 0.57 | 35 | Comparative example |
| | -2 | 8.0 | 0.3 | 516 | 290 | 0.56 | 35 | Invention example |
| F | -1 | 3.7 | 3.0 | 519 | 301 | 0.58 | 34 | Comparative example |
| | -2 | 6.2 | 1.4 | 527 | 288 | 0.55 | 36 | Invention example |
| G | -1 | 2.8 | 3.0 | 461 | 255 | 0.55 | 38 | Comparative example |
| | -2 | 6.6 | 1.3 | 465 | 240 | 0.52 | 39 | Invention example |

TABLE 10-continued

| | | | | | | | | |
|---|---|---|---|---|---|---|---|---|
| H | -1 | 7.6 | 1.6 | 621 | 354 | 0.57 | 31 | Invention example |
| | -4 | 2.6 | 2.5 | 615 | 339 | 0.55 | 32 | Comparative example |
| I | -1 | 4.0 | 2.6 | 513 | 280 | 0.55 | 35 | Comparative example |
| | -2 | 8.8 | 0.1 | 521 | 294 | 0.56 | 36 | Invention example |

*F: ferrite, B: bainite, M: martensite, P: pearlite, A: austenite Carbides and precipitates are omitted.
Note:
Underlined entries are outside the ranges of the present invention.

The present invention makes it possible to produce a high strength steel sheet having a good r-value and being excellent in deep drawability.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It should further be noted that any patents, applications or publications referred to herein are incorporated by reference in their entirety.

The invention claimed is:

1. A method for producing a steel sheet excellent in formability, comprising the steps of:

hot rolling a steel consisting essentially of, by mass, 0.08 to 0.25% C, 0.001 to 1.5% Si, 0.01 to 2.0% Mn, 0.001 to 0.007% P, at most 0.05% S, 0.001 to 0.007% N, 0.008 to 0.2% Al, and a balance of Fe and unavoidable impurities, at a finishing temperature of the $Ar_3$ transformation temperature −50° C. or higher, into a steel sheet;

coiling the hot rolled steel sheet at 500° C. or lower;

cold rolling the hot rolled steel sheet at a reduction ratio of more than 25% to less than 60%, wherein the hot rolled steel sheet has a structure composed of more than 97% bainite single phase;

heating the cold rolled steel sheet at an average heating rate of 4 to 200° C./h.;

annealing the heated steel sheet at a maximum arrival temperature of 600° C. to 800° C.; and cooling the annealed steel sheet at a cooling rate of more than 5° C./h. to not exceeding 17° C./h.

2. The method according to claim 1, wherein the steel sheet having ratios of X-ray diffraction intensities in the orientation components of {111}, {100} and {110} to random X-ray diffraction intensities on a reflection plane at the thickness center of said steel sheet are at least 2.0, at most 1.0 and at least 0.2, respectively.

3. The method according to claim 1, wherein the steel sheet having an average size of a plurality of grains of said steel sheet being 15 μm or more.

4. The method according to claim 3, wherein the steel sheet having an average aspect ratio of the plurality of grains of said steel sheet being in the range from 1.0 to 3.0.

5. The method according to claim 3, wherein the steel sheet having a yield ratio of said steel sheet is at most 0.65.

* * * * *